US007329151B2

(12) United States Patent
Wu

(10) Patent No.: US 7,329,151 B2
(45) Date of Patent: Feb. 12, 2008

(54) CONNECTOR ASSEMBLY WITH STRAIN RELIEF MEMBER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 28 days.

(21) Appl. No.: 11/476,294

(22) Filed: Jun. 28, 2006

(65) Prior Publication Data

US 2008/0003881 A1 Jan. 3, 2008

(51) Int. Cl.
*H01R 9/03* (2006.01)

(52) U.S. Cl. ..... 439/610; 439/456; 439/465; 439/490

(58) Field of Classification Search ..... 439/456, 439/459, 465, 466, 467, 490, 610
See application file for complete search history.

(56) References Cited

U.S. PATENT DOCUMENTS 2,869,091 A * 1/1959 Robards ..... 439/503
3,877,775 A * 4/1975 Barlow et al. ..... 439/204
4,580,862 A * 4/1986 Johnson ..... 439/248
5,244,415 A * 9/1993 Marsilio et al. ..... 439/610
5,364,292 A 11/1994 Bethurum
5,667,407 A 9/1997 Frommer et al.
6,663,415 B1 12/2003 Wu
6,733,333 B1 5/2004 Chen
7,217,142 B1 * 5/2007 Wu ..... 439/79
7,247,046 B1 * 7/2007 Wu ..... 439/490

* cited by examiner

*Primary Examiner*—James Harvey
(74) *Attorney, Agent, or Firm*—Wei Te Chung

(57) ABSTRACT

A cable connector assembly (100) includes a housing (2), a signal contact (31), a ground contact (32) assembled to the housing, a circuit board (4) assembled to the housing and electrically connecting with the contacts, a cable (6) comprising a conductor (60) directly connecting with the circuit board (4) and a metal braiding layer (61) electrically with a strain relief member (5) which electrically connects with the circuit board, and a rear cover (7) assembled to the housing to enclose the electrical connection among the cable, the strain relief member, the circuit board and the contacts.

18 Claims, 32 Drawing Sheets

CONNECTOR ASSEMBLY WITH STRAIN RELIEF MEMBER

BACKGROUND OF THE INVENTION

1. Field of the Invention

The present invention generally relates to a connector assembly, and more particularly to a connector assembly used for power transmission.

2. Description of Related Art

To connect a pair of connectors, a cable member is usually needed. Such a cable member generally comprises at least one inner conductor for signal transmission, a metal braiding layer enclosing the inner conductor for shielding the signal transmission and an outer jacket made from insulative material for protection. For achieving better signal transmission effect and reducing EMI in transmission, the metal braiding layer usually electrically connects with a single cable holder which electrically connects with a conductive shell, as disclosed in U.S. Pat. No. 6,663,415, thus, reducing the EMI. The metal braiding layer also can be grasped by a strain relief area of a conductive shell to form electrical connection, thus, reducing EMI in signal transmission, as disclosed in U.S. Pat. No. 5,667,407. However, in some circumstances, the connecting manners as described above are not suitable, a new design is needed to fit different application.

BRIEF SUMMARY OF THE INVENTION

Accordingly, an object of the present invention is to provide a connector assembly with improved strain relief structure for achieving more reliable connection.

In order to achieve the above-mentioned object, a connector assembly in accordance with the present invention comprises a housing assembled with a signal terminal and a ground terminal, a cable comprising a signal conductor directly electrically connecting with the signal terminal and a metal braiding layer enclosing the signal conductor, a strain relief member defining a through hole to permit the signal conductor protruding through and a jointing portion directly connecting with the ground terminal. The metal braiding layer of the cable electrically connects with strain relief member.

Other objects, advantages and novel features of the invention will become more apparent from the following detailed description of the present embodiment when taken in conjunction with the accompanying drawings.

DETAILED DESCRIPTION OF THE INVENTION

Figure 1:
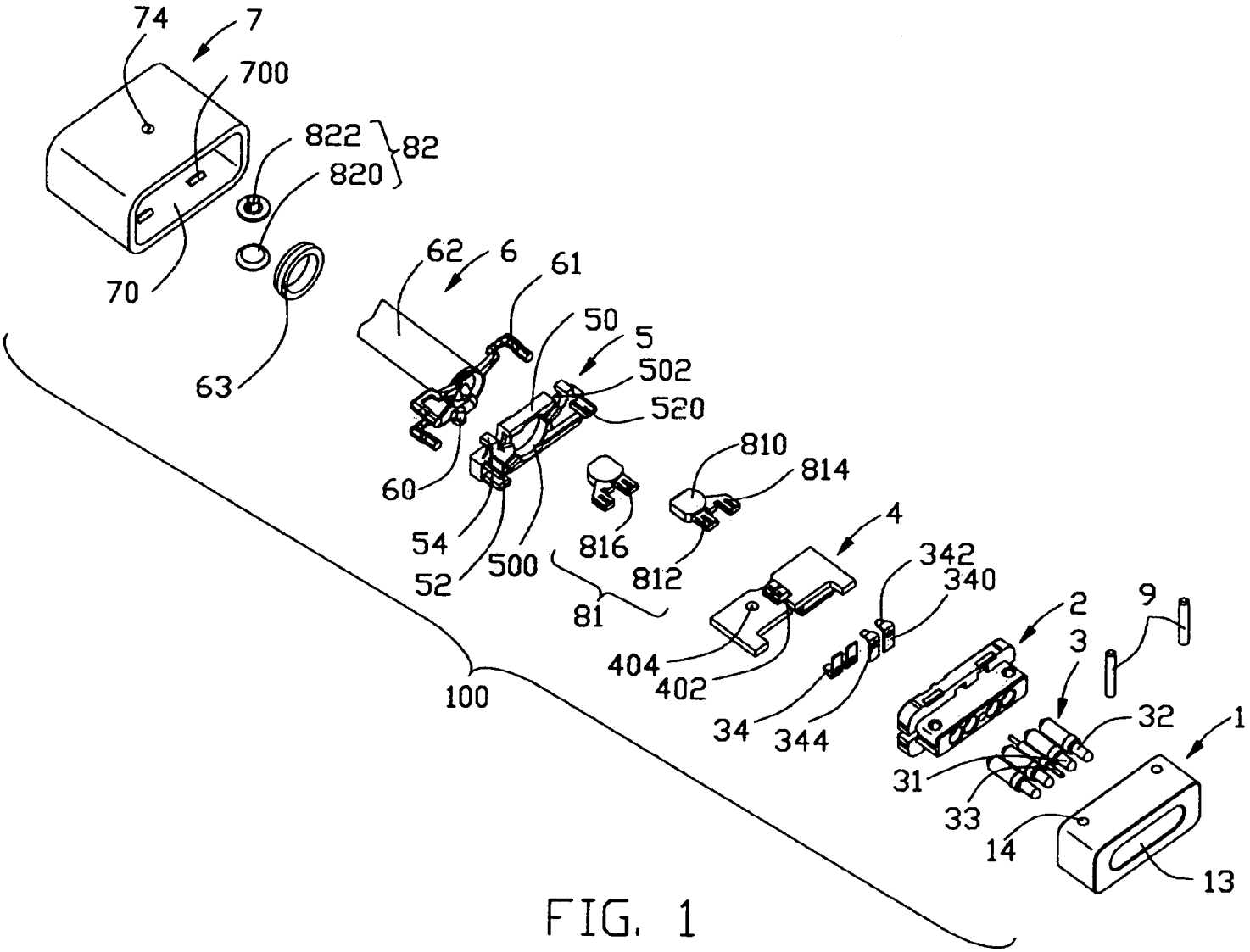
FIG. 1 is an exploded, perspective view of a connector assembly in accordance with the first embodiment of the present invention.

Reference will now be made to the drawing figures to describe the present invention in detail.

Figure 2:
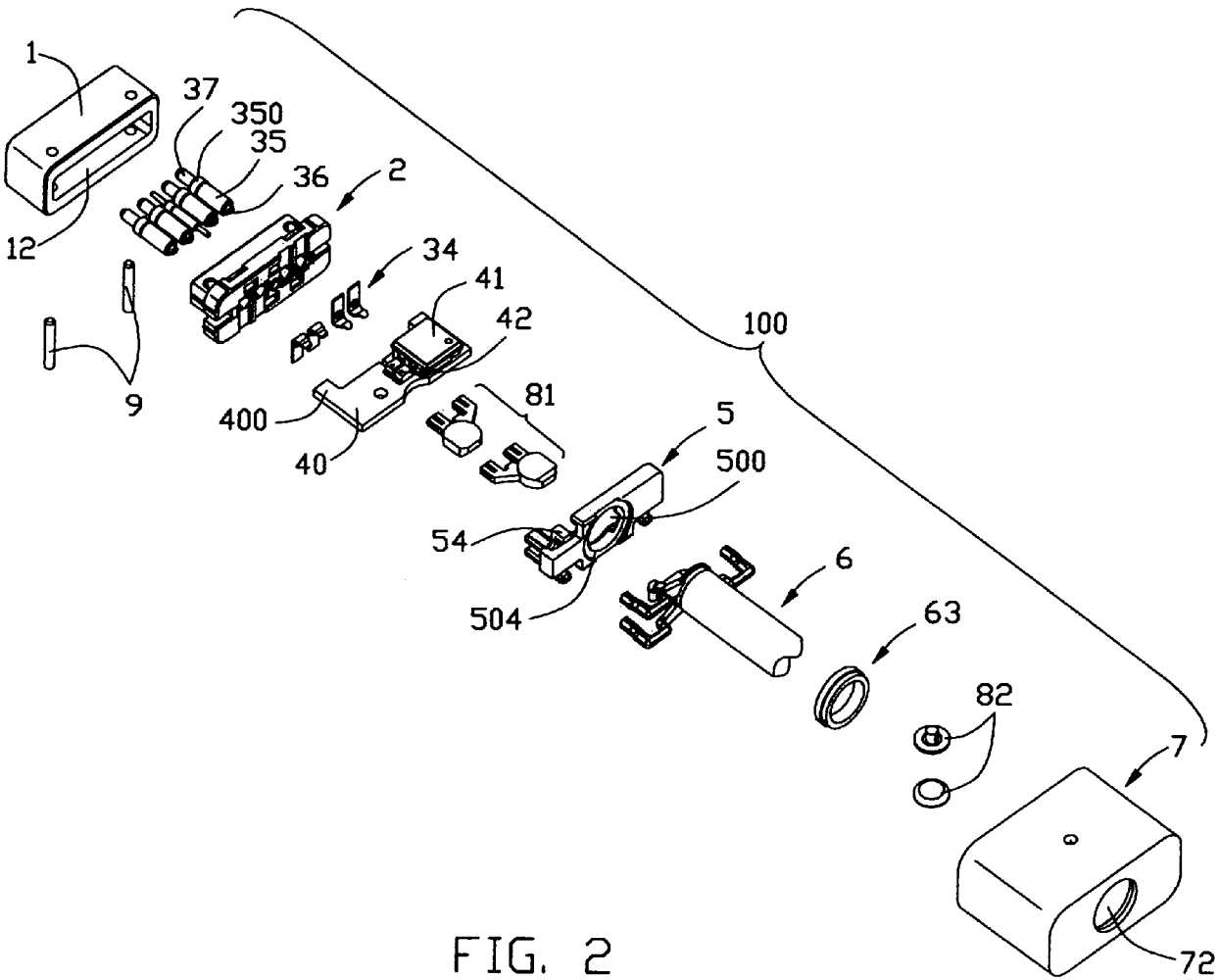
FIG. 2 is a view similar to FIG. 1, but viewed from a different aspect.
Figure 3:
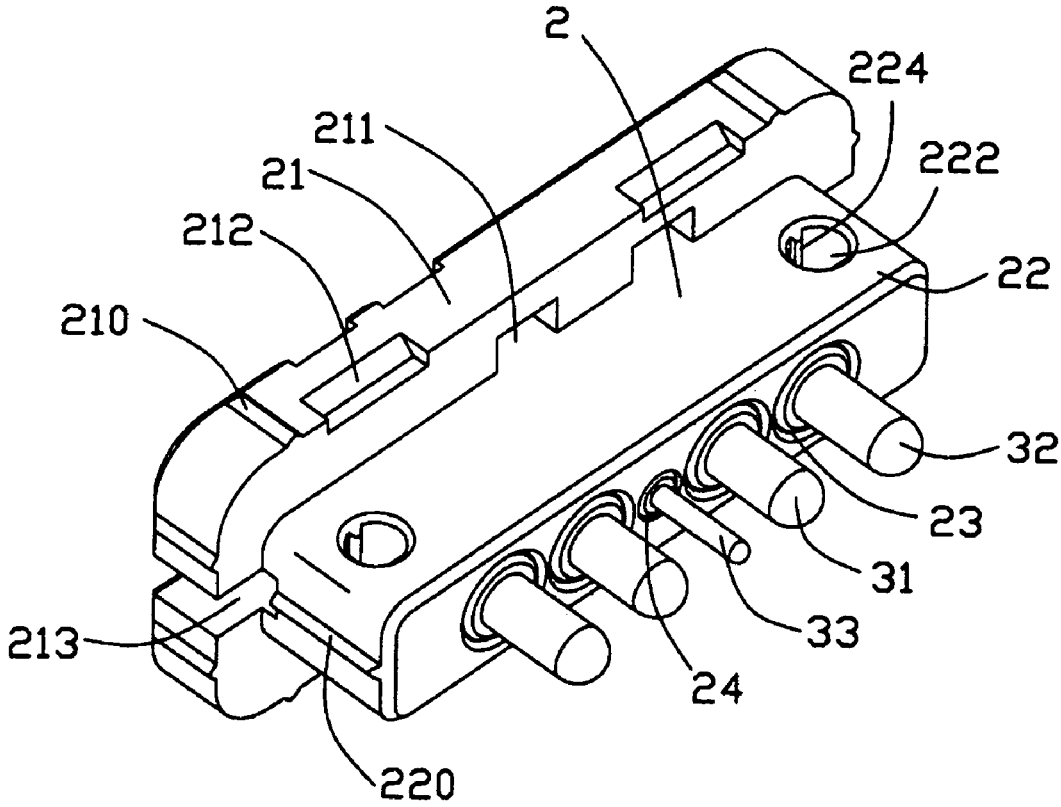
FIG. 3 is a partially assembled view of the connector assembly of FIG. 1.

Referring to FIGS. 1-3, a connector assembly 100 in accordance with the first embodiment of the present invention comprises a housing 2, a plurality of conductive contacts 3 assembled to the housing 1, a circuit board 4 assembled to the housing 1, a plurality of conductive elements 34 respectively electrically connecting with the contacts 3 and the circuit board 4, a strain relief member 5 assembled to and electrically connecting with the circuit board 4, a cable 6 electrically connecting with the die cast member 5 to achieve the electrical connection with the circuit board 4, front and rear covers 1, 7 respectively assembled to the housing 2 and together enclosing the elements mentioned above therebetween.

Figure 4:
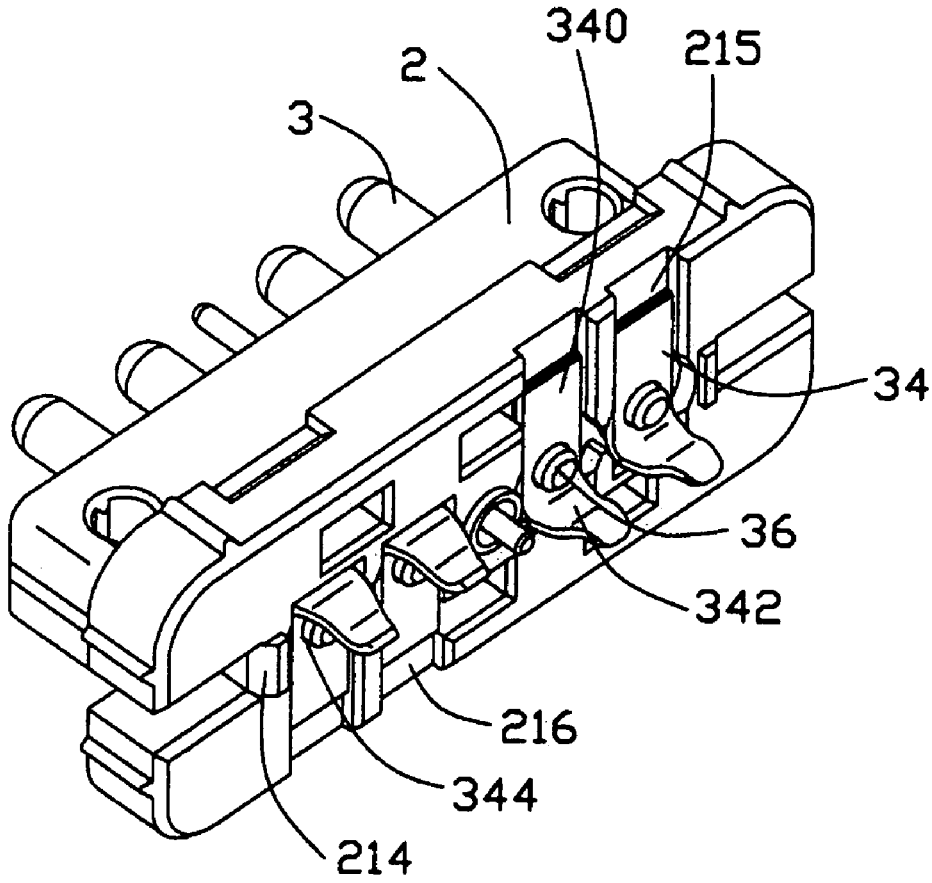
FIG. 4 is a view similar to FIG. 3, but viewed from a different aspect.

Please refer to FIGS. 3-4, the housing 2 comprises a base portion 21 and a tongue portion 22 extending forwardly from the base portion 21. The housing 2 defines two pairs of first receiving passages 23 and a center second passage 24 respectively recessed from a front face of the tongue portion 22 to a rear face of the base portion 21. Each passage 23, 24 is formed with a relatively larger dimension in a front portion thereof and a relatively smaller dimension in remaining portion thereof. The base portion 21 forms a plurality of first friction ribs 210 arranged on outer periphery of the base portion 21 with an interval and extending along a front-to-back direction. A pair of cutouts 212 are respectively spaced arranged at joints of upper, lower surfaces and a front face of the base portion 21 with a tapered surface. The tongue portion 21 defines two pairs of rectangular first slots 211 spaced arranged in upper and lower walls and respectively recessed from the front face to the rear face thereof with determined distance from respective top and bottom surfaces. The tongue portion 21 also defines a pair of second slots 213 extending along the front-to-back direction to communicate the front face with opposite rear face and recessed inwardly from opposite lateral walls thereof. A pair of tapered protrusions 214 are formed on the rear face of the base portion 21 and locate adjacent to the pair of second slots 213 facilitating the insertion of the circuit board 4. A pair of first rectangular recesses 215 and a pair of second rectangular recesses 216 with opening toward opposite contrary directions respectively recessed forwardly from the rear face of the base portion 21 and respectively communicating with the first receiving passages 23. The tongue portion 22 defines a pair of circular first engaging holes 222 extending therethrough along up-to-down direction and forms a pair of second friction ribs 220 on opposite lateral walls thereof extending along the front-to-back direction. Each engaging hole 222 forms a pair of ribs 224 protruding outwardly from inner periphery thereof.

Now referring to FIGS. 1-4, the conductive contacts 3 consist of a pair of ground contacts 32, a pair of power contacts 31 located between the pair of ground contacts 32 and a center detect contact 33 located between the pair of power contacts 31. Each contact 3 is of a POGO Pin type, that is to say, there is a spring inside the contact 3, thus, when mating, the contact 3 can be pressed to rearward move along the mating direction. However, this is not the emphasis of the present invention, therefore, the description of inner structure of the contact 3 is omitted in the present invention. Each ground contact 32 comprises a column-shape contacting portion 37 with a relatively small diameter, a column-shape media portion 35 with a relatively large diameter, and an end portion 36 formed at rear end of the media portion 35 with a column-shape and smaller diameter. A front engaging section 350 protrudes outwardly from outer periphery of the media portion 35. The power contact 32 has the same structure as that of the ground contact 31 except the contacting portion 37 thereof has a length shorter than that of the ground contact 31. The detect contact 33 has the same structure as that of the power contact 32 except each portion thereof has a smaller diameter than that of the power contact 32. In addition, the end portion 36 of the detect contact 33 is longer than that of the power or ground contact 31, 32.

Referring to FIGS. 1-2 and 4, the conductive elements 34 are divided into two groups respectively oriented in opposite directions. Each conductive element 34 is of L-shape and comprises an upright connecting portion 340 defining a circular receiving opening 344 therein, and a curved tail portion 342 substantially vertically extending from the connecting portion 340.

Referring to FIGS. 1-2, the circuit board 4 comprises a substrate 40 formed with first conductive pads and opposite second conductive pads (not shown), and a pair of LEDs 42 arranged on opposite sides of the substrate 40. The circuit board 4 may be equipped with an IC 41 for driving the LEDs 42 to emit light. The substrate 40 comprises a pair of stretching arms 400 extending forwardly from opposite lateral sides thereof and defines a wire-receiving hole 404 in a rear portion thereof.

The strain relief member 5 is die casted from metal material or other conductive material. The strain relief member 5 comprises a main portion 50 defining a circular through hole 500 in a center thereof. Three corners of the main portion 50 are cutout to form three L-shape cutout areas 502. Three jointing portions 52 respectively forwardly extending from a front surface of the main portion 50 and respectively located adjacent to both corresponding cutout area 502 and corresponding lateral side of the main portion 50. Three substantially L-shape routing portions 54 firstly vertically extending from bottoms of corresponding cutout areas 502, then flatly extending into the three cutout areas 502. In the vertical direction, each routing portion 54 does not align with corresponding jointing portion 52. Each jointing portion 52 is partially cut to form a curved recess area 520. A substantially circular receiving opening 504 recesses forwardly from a rear surface of the main portion 50 to communicate with the through hole 500 with a larger diameter than that of the through hole 500.

The cable 6 comprises an inner conductor 60, a metal braiding layer 61 surrounding the inner conductor 60, and an outer jacket 62 enclosing the metal braiding layer 61. A front portion of the outer jacket 62 is stripped to expose part of the inner conductor 60 and the metal braiding layer 61. In this embodiment, the exposed portion of the metal braiding layer 61 is divided into three parts corresponding to the routing portions 54 and the jointing portions 52 of the strain relief member 5. The cable 6 may be equipped with a stepped-shape stuffing member 63.

Figure 11:
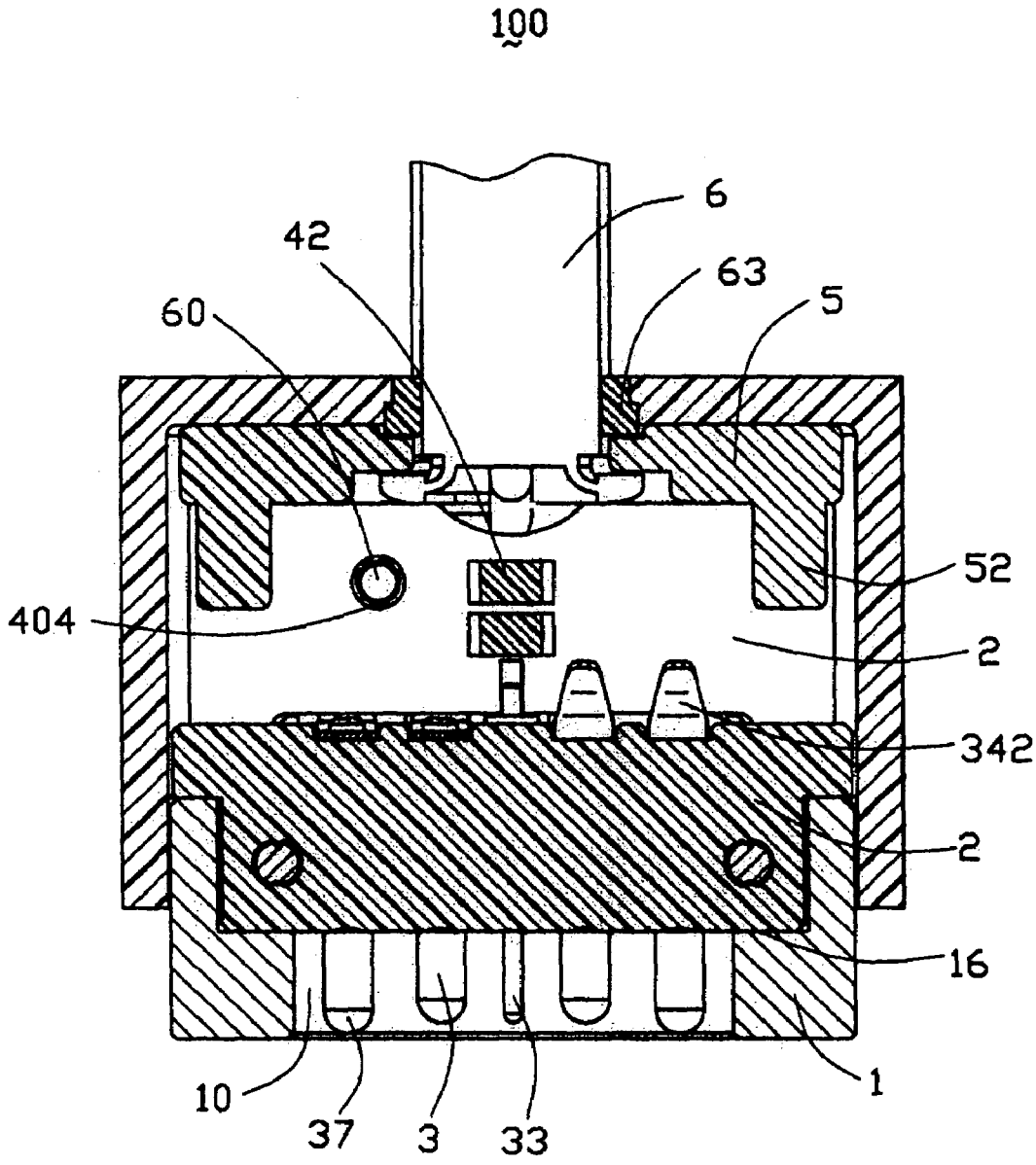
Figure 12:
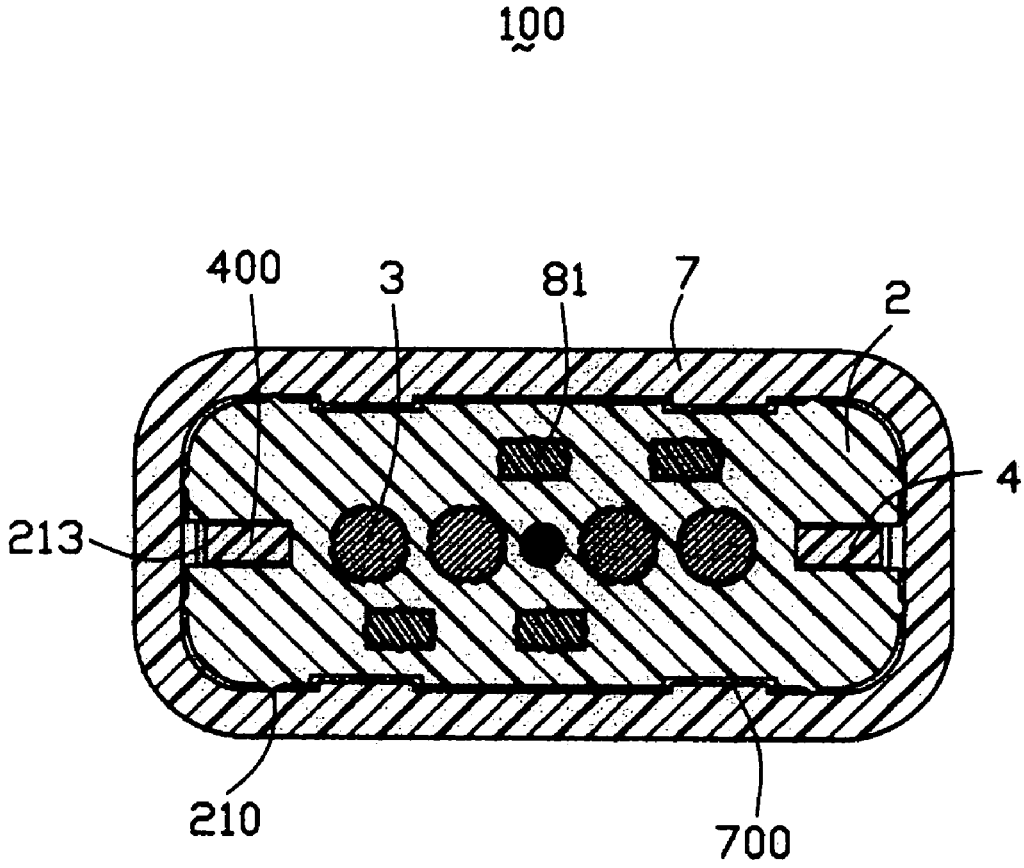

The front and rear covers 1, 7 are respectively assembled to the housing 2. The front cover 1 is made from conductive material and defines an elliptical-shape front receiving cavity 10 recessed rearwardly from a front surface thereof for receiving complementary connector and a rectangular rear receiving passage 12 recessed forwardly from a rear surface thereof to communicate with the front receiving cavity 10 for receiving the housing 2. The receiving passage 12 has a large size along a lateral direction of the front cover 1 than that of the receiving cavity 10, thus, forming a pair of step portions 16 therebetween (FIG. 11). The front cover 1 also defines a pair of circular second engaging holes 14 respectively extending from a top surface to opposite rear surface thereof and locating adjacent to the rear surface thereof. The rear cover 7 is of rectangular shape and defines a rectangular receiving space 70 recessed rearwardly from a front surface thereof and a rear stepped receiving passage 72 communicating with the receiving space 70 for permitting the protruding of the cable 6 and receiving the stuffing member 63. The rear cover 7 forms two pairs of protrusions 700 on opposite inner upper wall and opposite lower wall thereof and a pair of circular receiving holes 74 extending through top and bottom surfaces thereof.

The cable connector assembly 100 also comprises a light spread member (not labeled) made of transparent material or semitransparent material and consisting of a pair of first light pipes 81 overlapping the pair of LEDs 42 for spreading the light emitted by the LEDs 42 outwardly, and a pair of second light pipes 82 aligned with corresponding first light pipes 81 in a vertical direction and assembled to the rear cover 7 to spread the light permeated by the first light pipes 81 outwardly for indicating the working status of the cable connector assembly 100. Each first light pipe 81 comprises a first body section 810 and a pair of first and second engaging sections 812, 814 respectively extending forwardly and sideward then forwardly from the first body section 810, thus, the pair of first and second engaging sections 812, 814 are spaced arranged along the lateral direction. In addition, each engaging section 812, 814 forms a pair of ribs 816 on opposite upper and lower surfaces thereof. The second light pipe 82 comprises a second body section 820 and a post-shape positioning section 822 extending outwardly from a center of the second body section 820. In assembly, the pair of first light pipes 81 and the pair of second light pipes 82 are respectively arranged in image relationship relative to each other.

Figure 10:
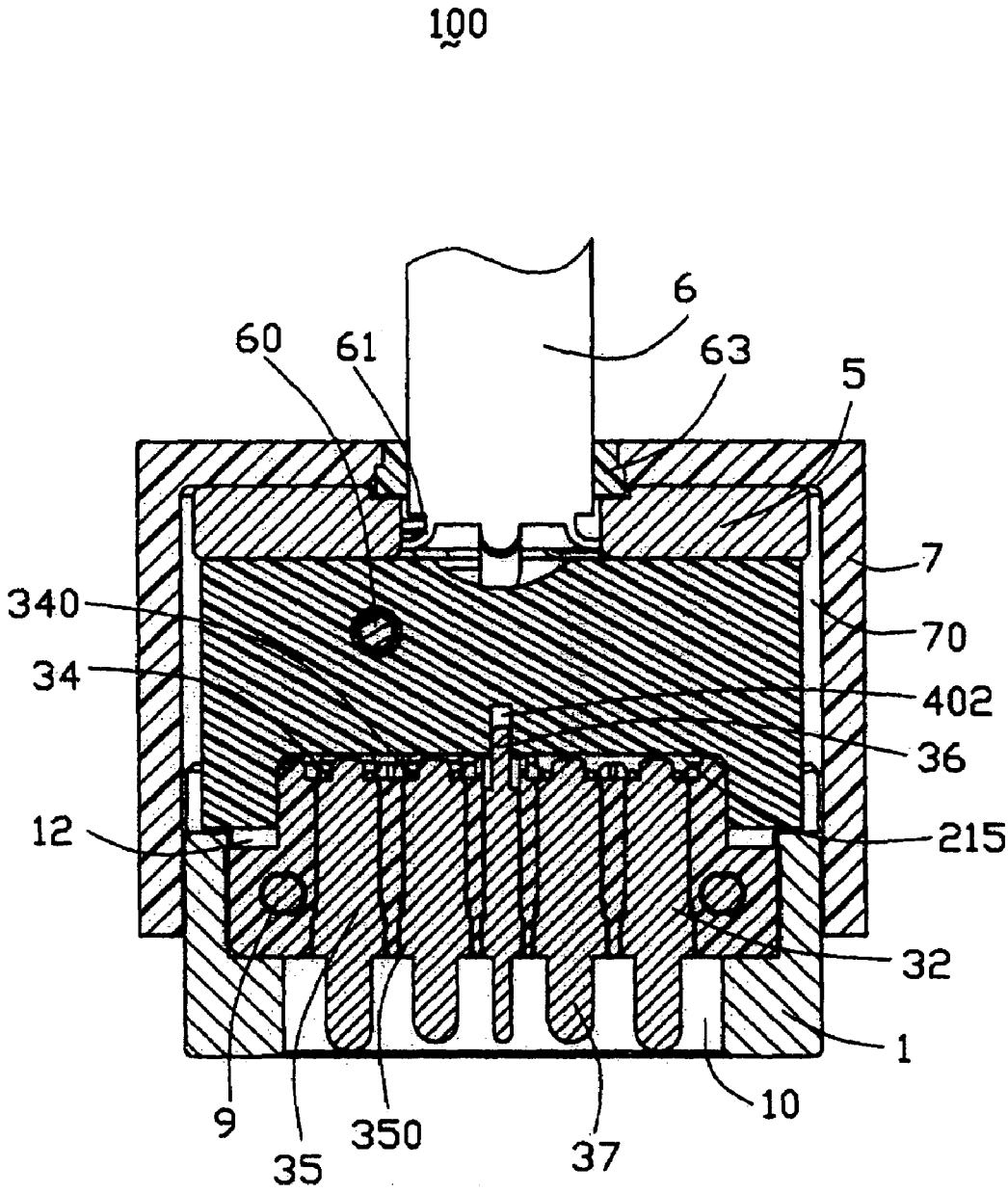

Referring to FIGS. 3-4 in conjunction with FIGS. 10-11, in assembly, the conductive contacts 3 are assembled to the housing 2 with the media portions 35 of the power contacts 31, ground contacts 32 and the detect contacts 33 respectively received in corresponding first and second receiving passages 23, 24, the contacting portions 37 exposed beyond the front surface of the housing 2. The end portions 36 of the power and ground contacts 31, 32 are respectively received in the first and second recesses 215, 216 and extend no longer than the rear surface of the housing 2, while, the end portion 36 of the detect contact 33 extends beyond the rear surface of the housing 2. The conductive elements 34 are respectively assembled to the housing 2 and the contacts 3 with the connecting portions 340 received in corresponding first and second recesses 215, 216 of the housing 2 and corresponding end portions 36 of the power and ground contacts 31, 32 protruding through the receiving openings 344 and soldered with the connecting portions 340. Thus, the conductive elements 34 form electrical connection with corresponding power and ground contacts 31, 32.

Figure 7:
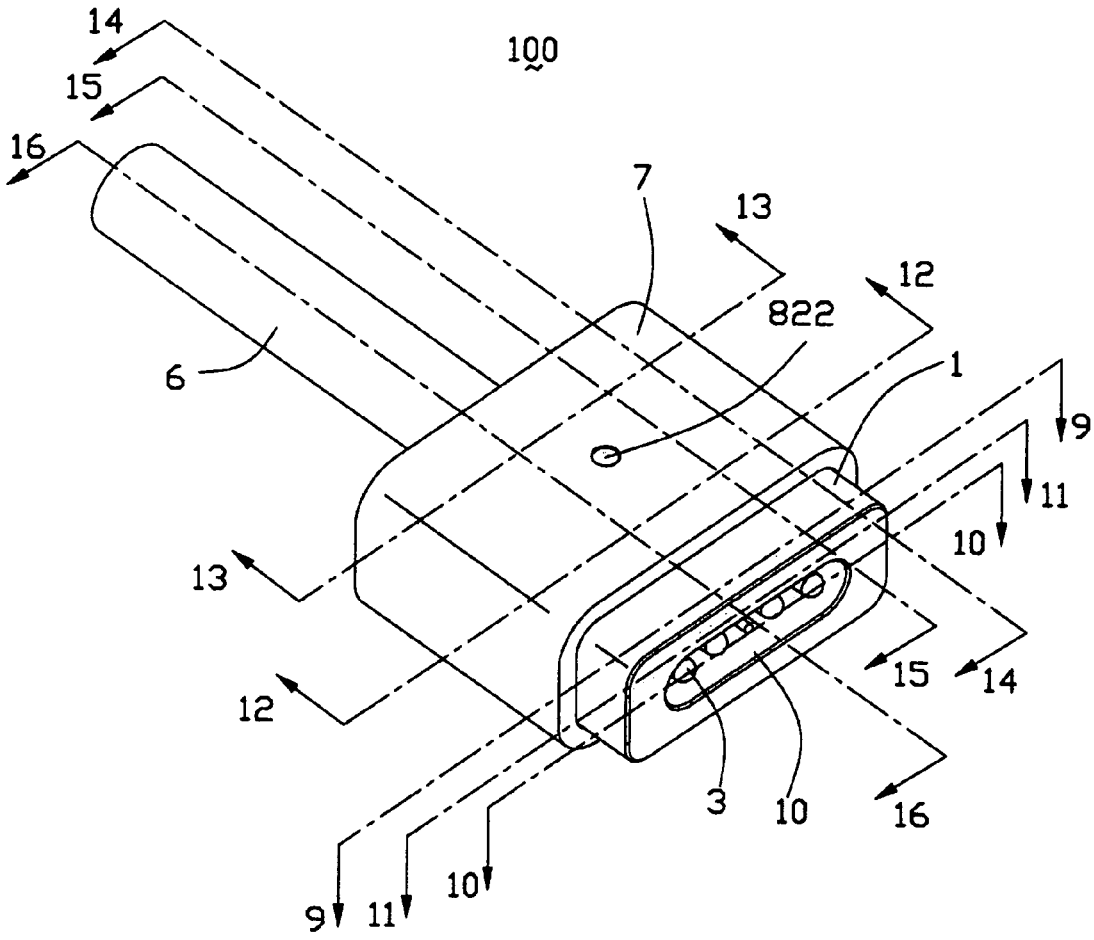
FIG. 7 is an assembled view of the connector assembly of FIG. 1.
Figure 8:
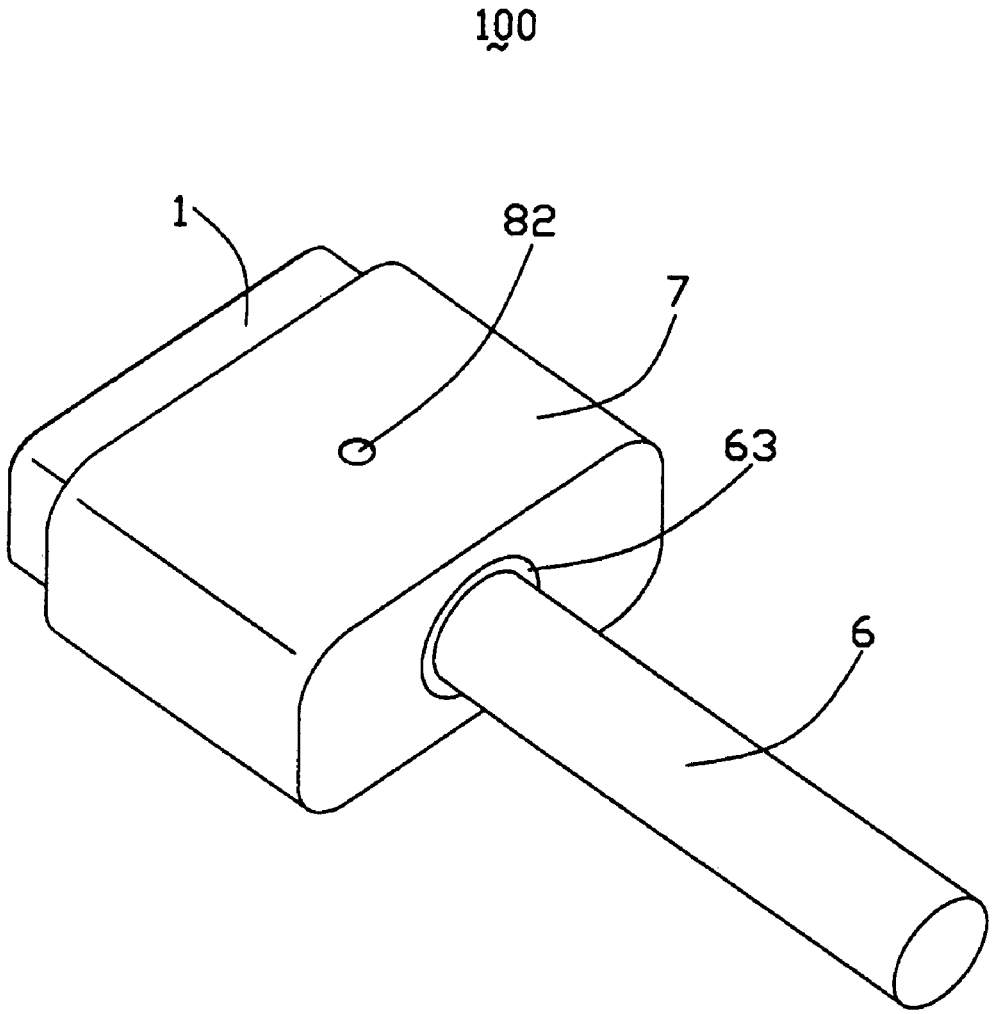
FIG. 8 is a view similar to FIG. 7, but viewed from a different aspect.
Figure 15:
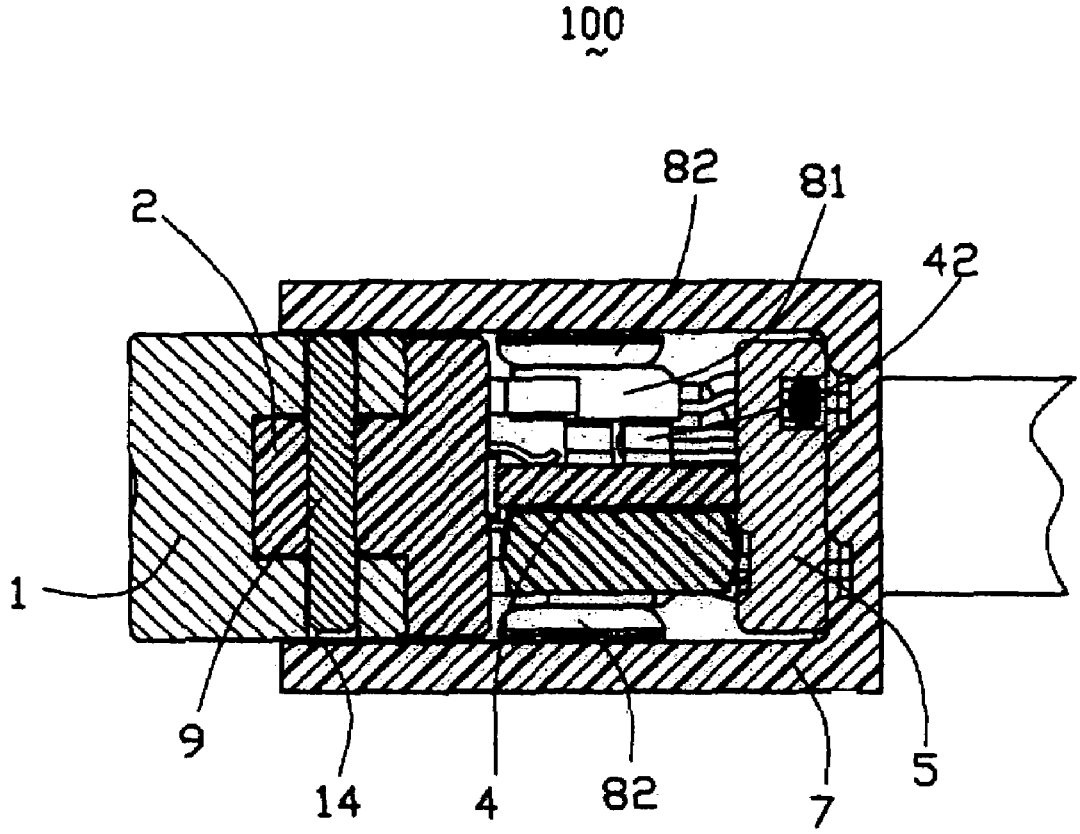
Figure 16:
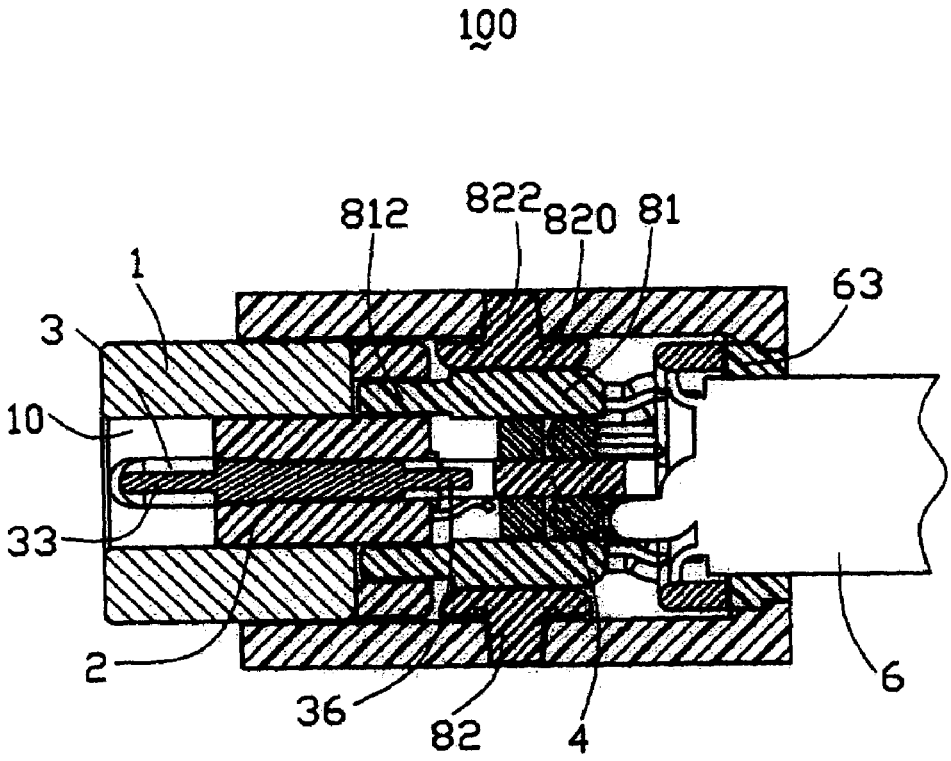
Figure 17:
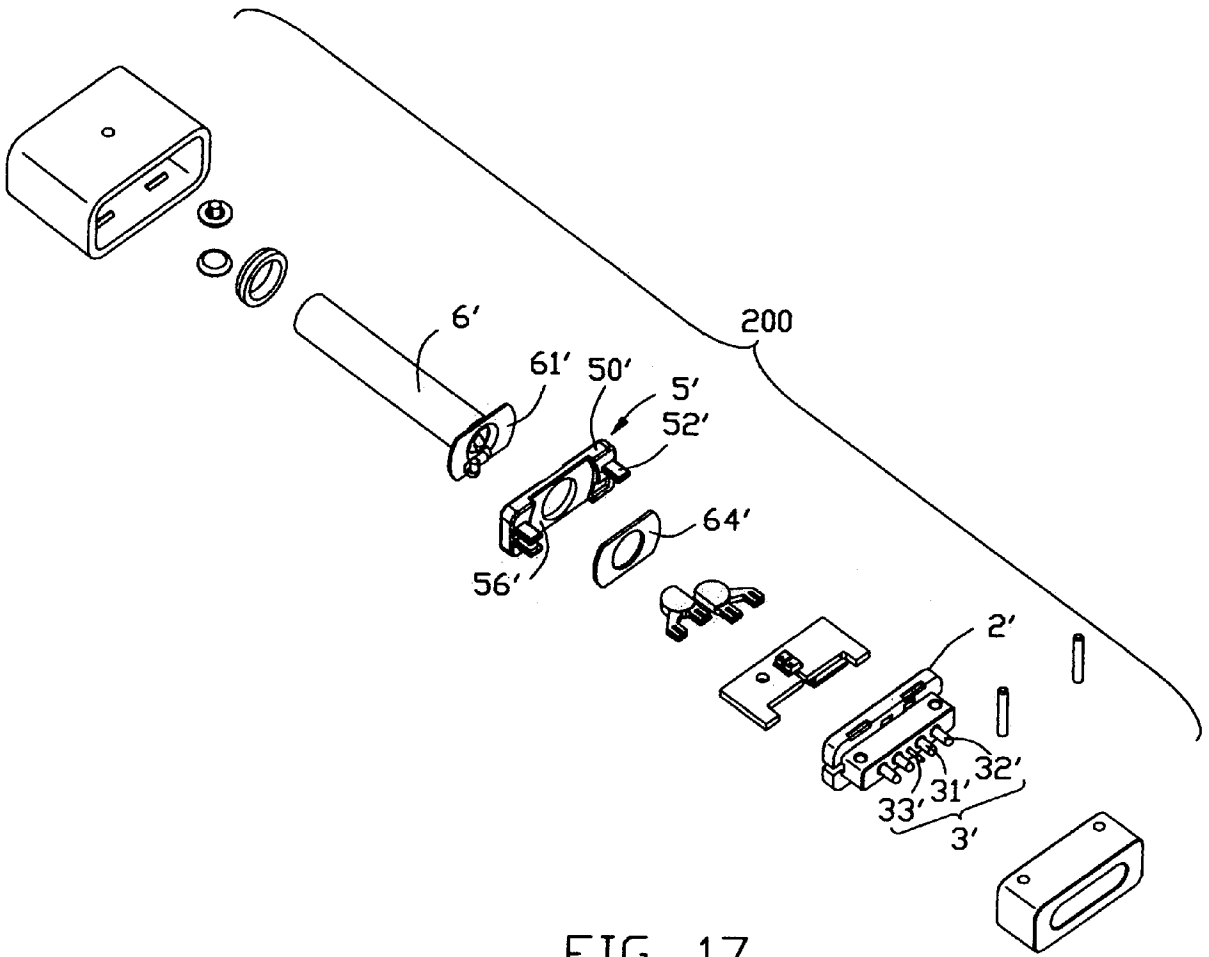
FIG. 17 is an exploded, perspective view of a connector assembly in accordance with the second embodiment of the present invention.
Figure 18:
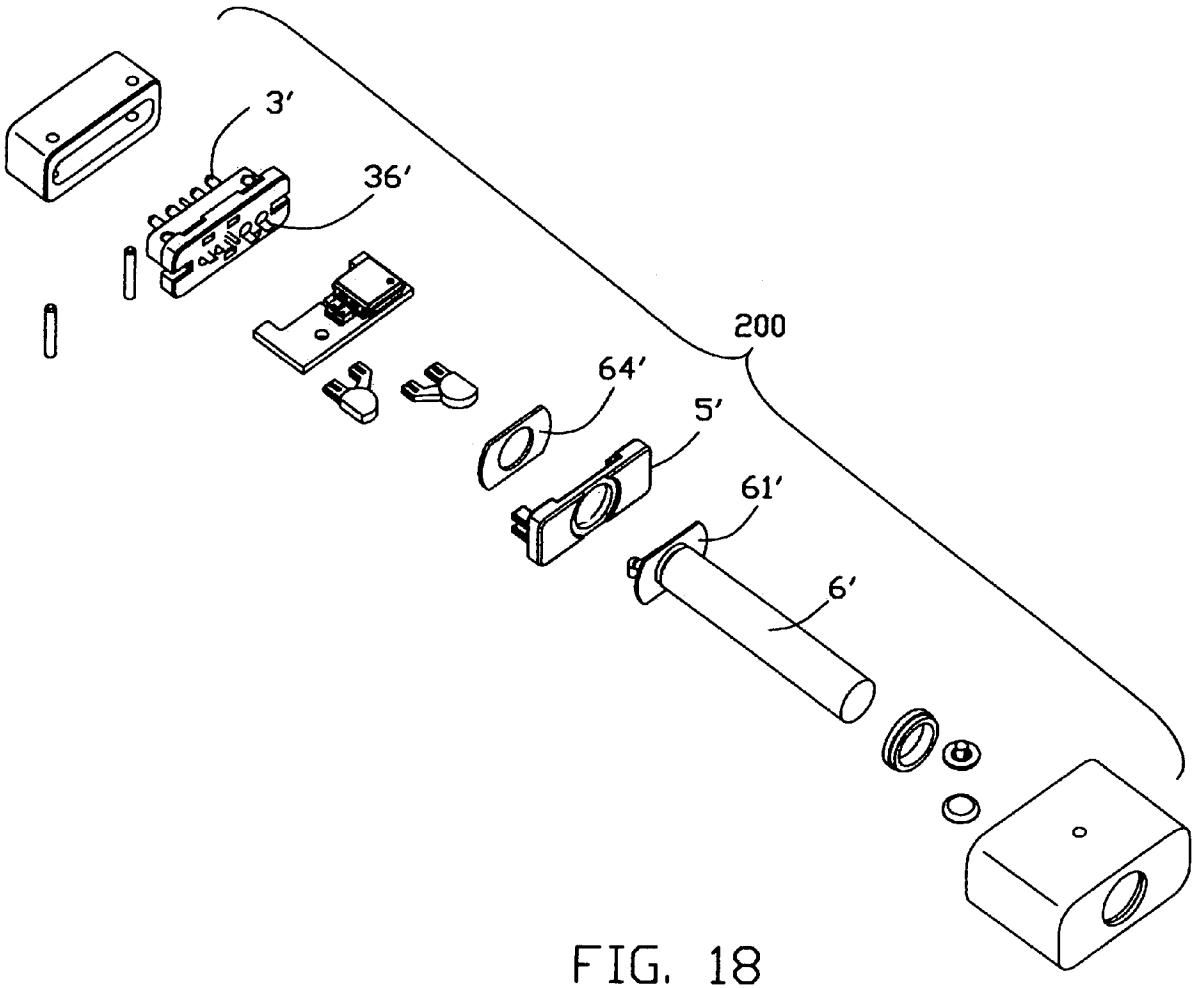
FIG. 18 a view similar to FIG. 17, but viewed from a different aspect.
Figure 19:
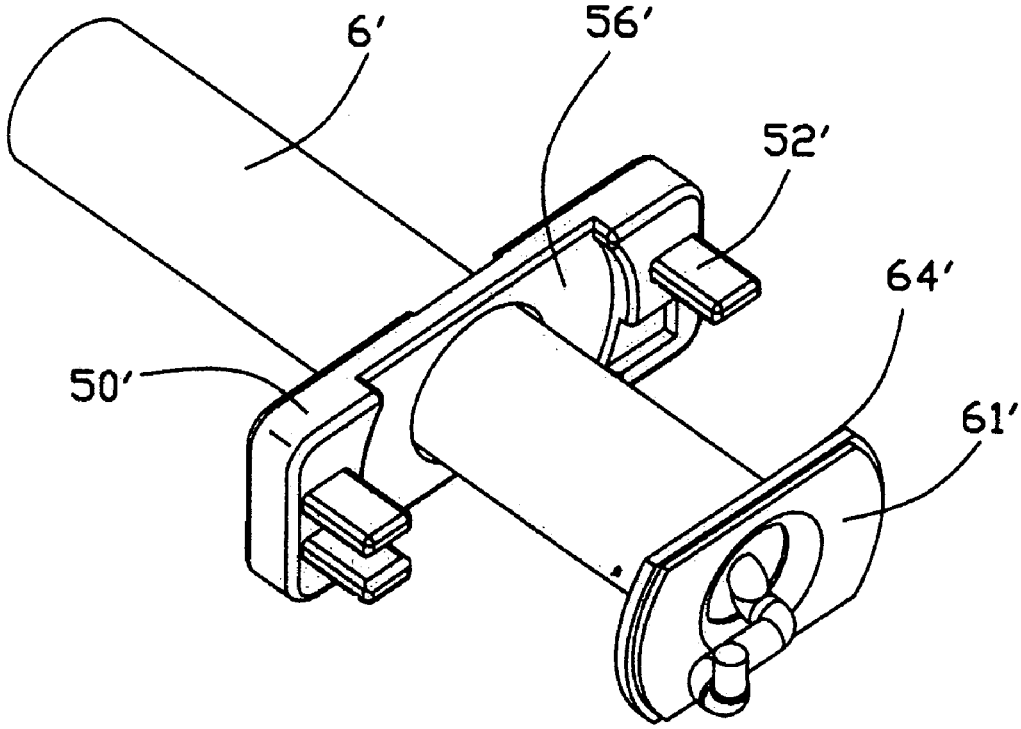
FIG. 19 is a partially assembled view of the connector assembly of the second embodiment.
Figure 20:
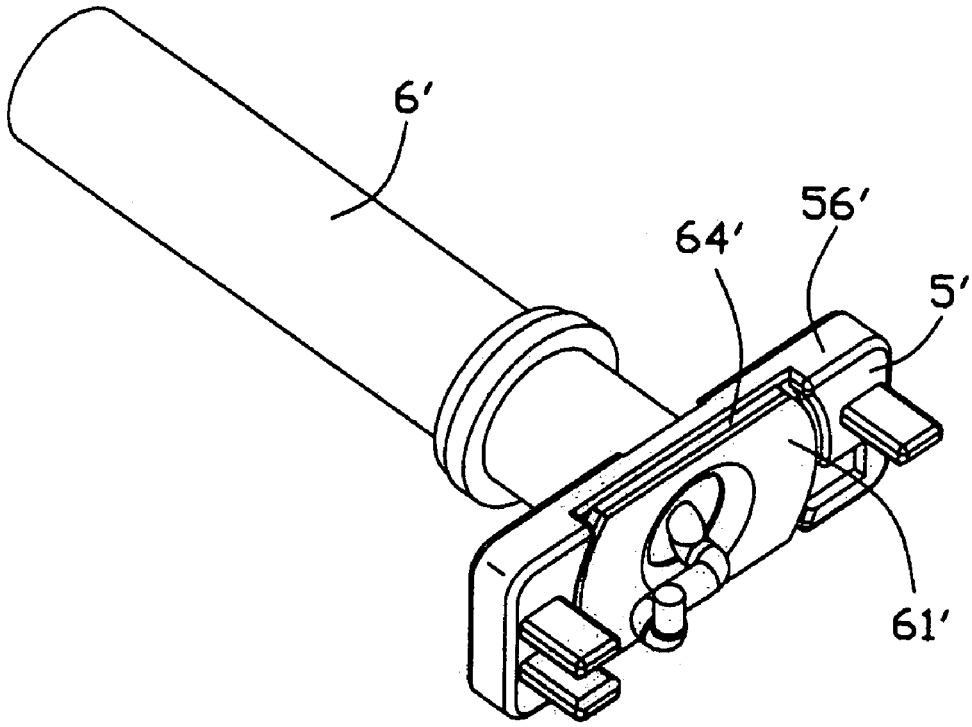
FIG. 20 is an assembled, perspective view of FIG. 19.
Figure 21:
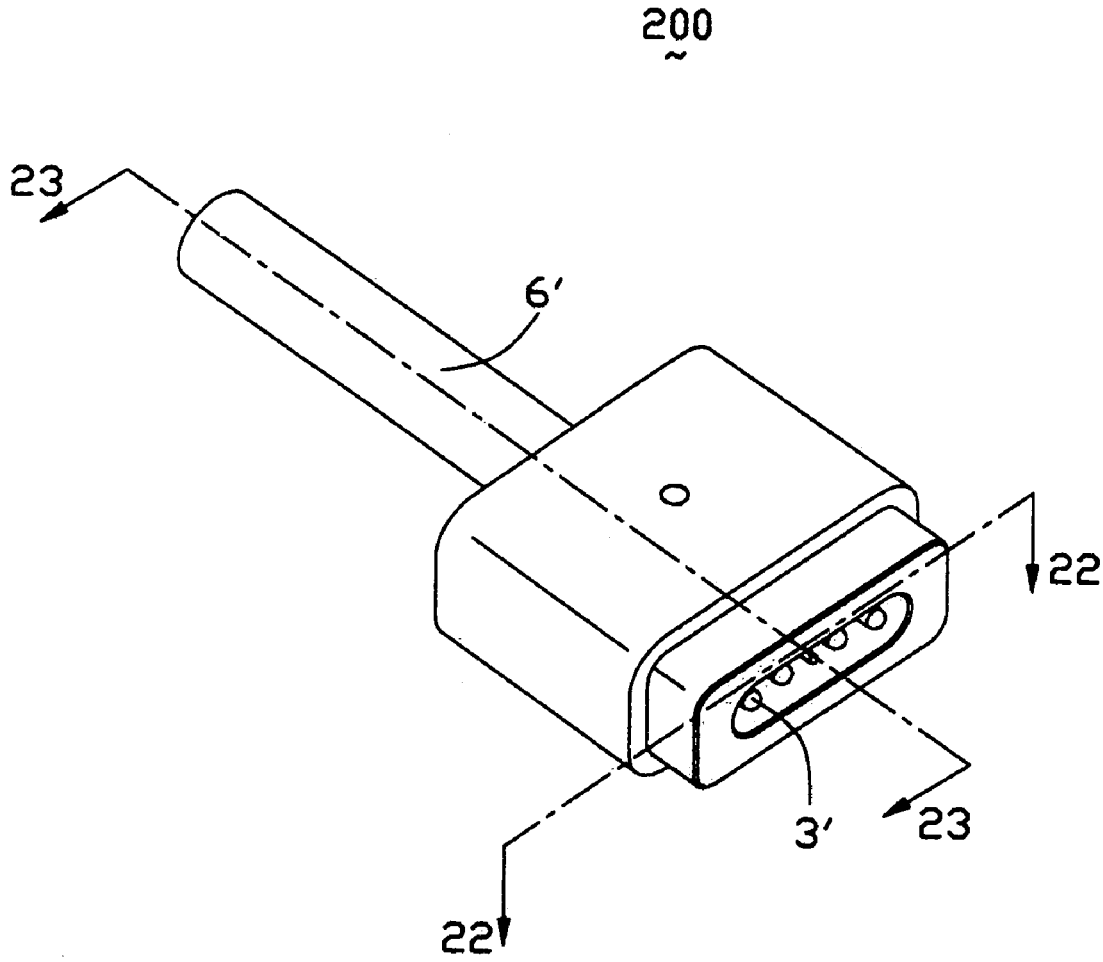
FIG. 21 is an assembled, perspective view of FIG. 17.
Figure 22:
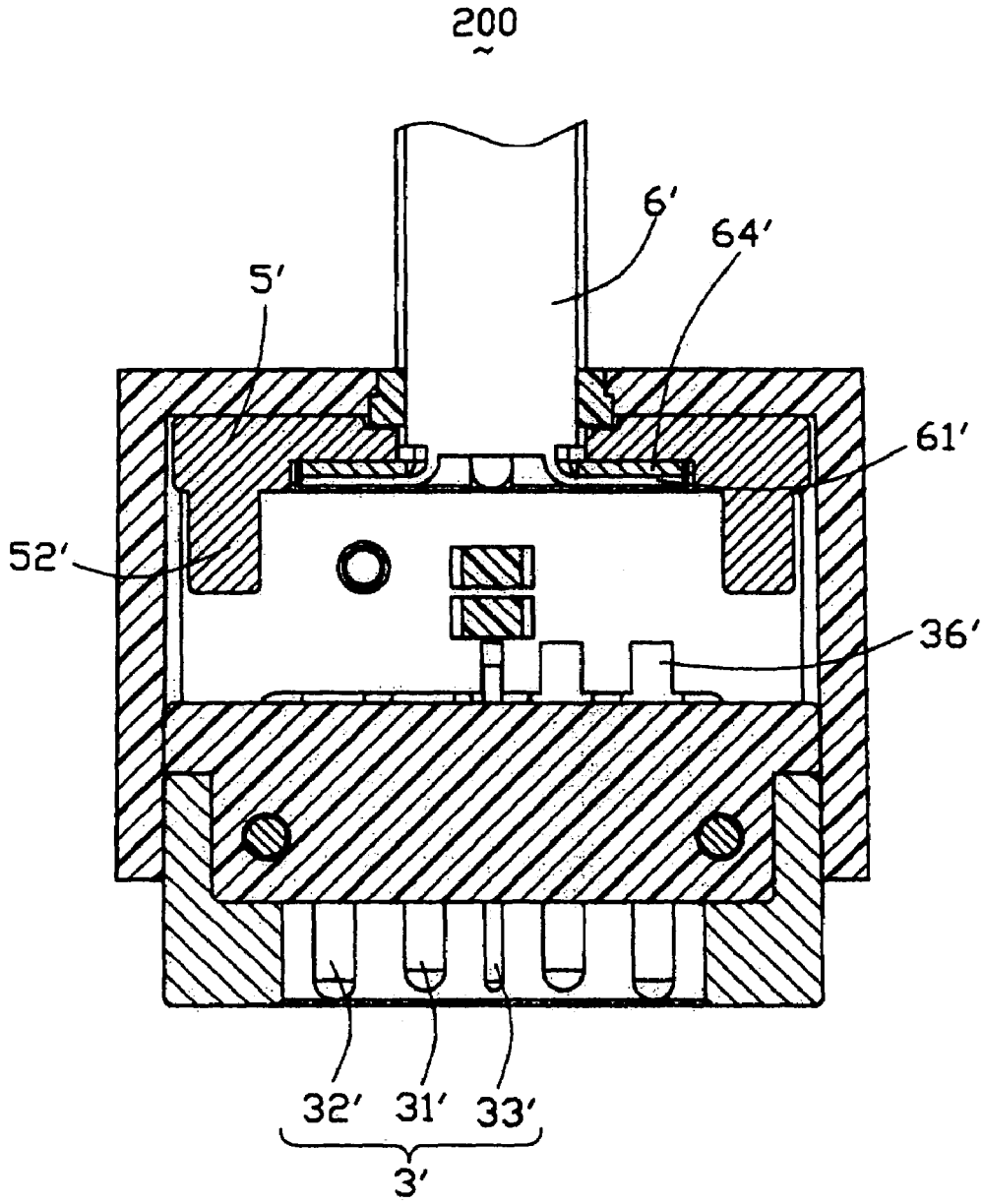
FIGS. 22-23 are cross-section views taken along lines 22-22 to 23-23 of FIG. 21.
Figure 23:
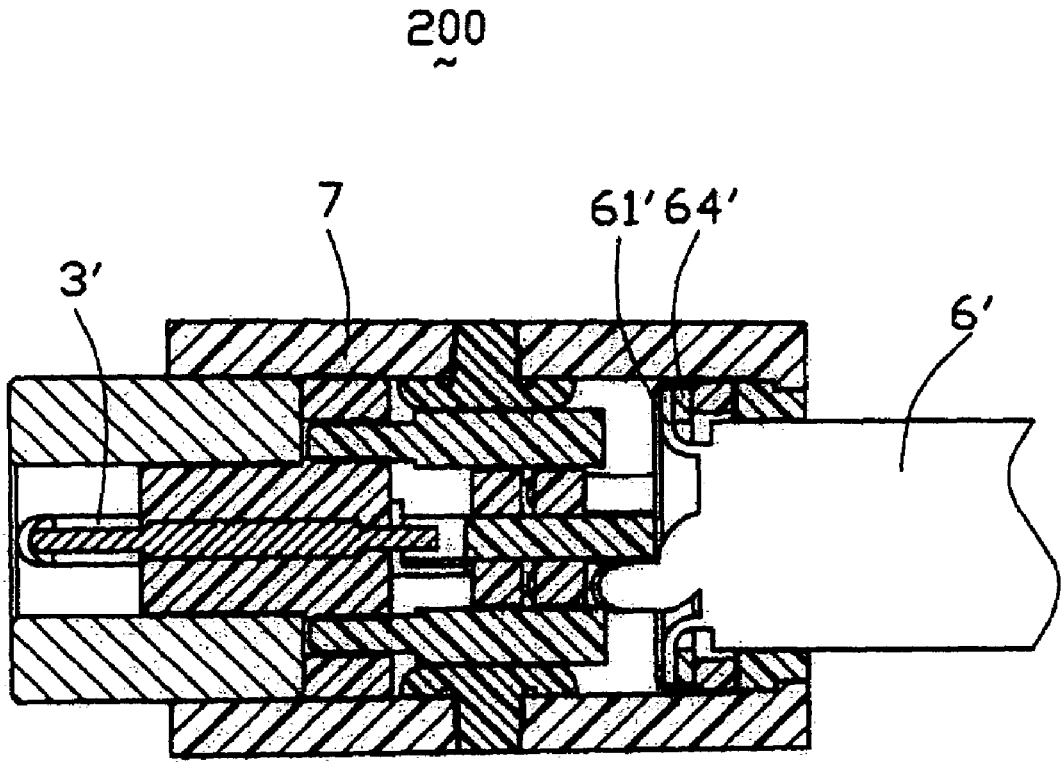
Figure 24:
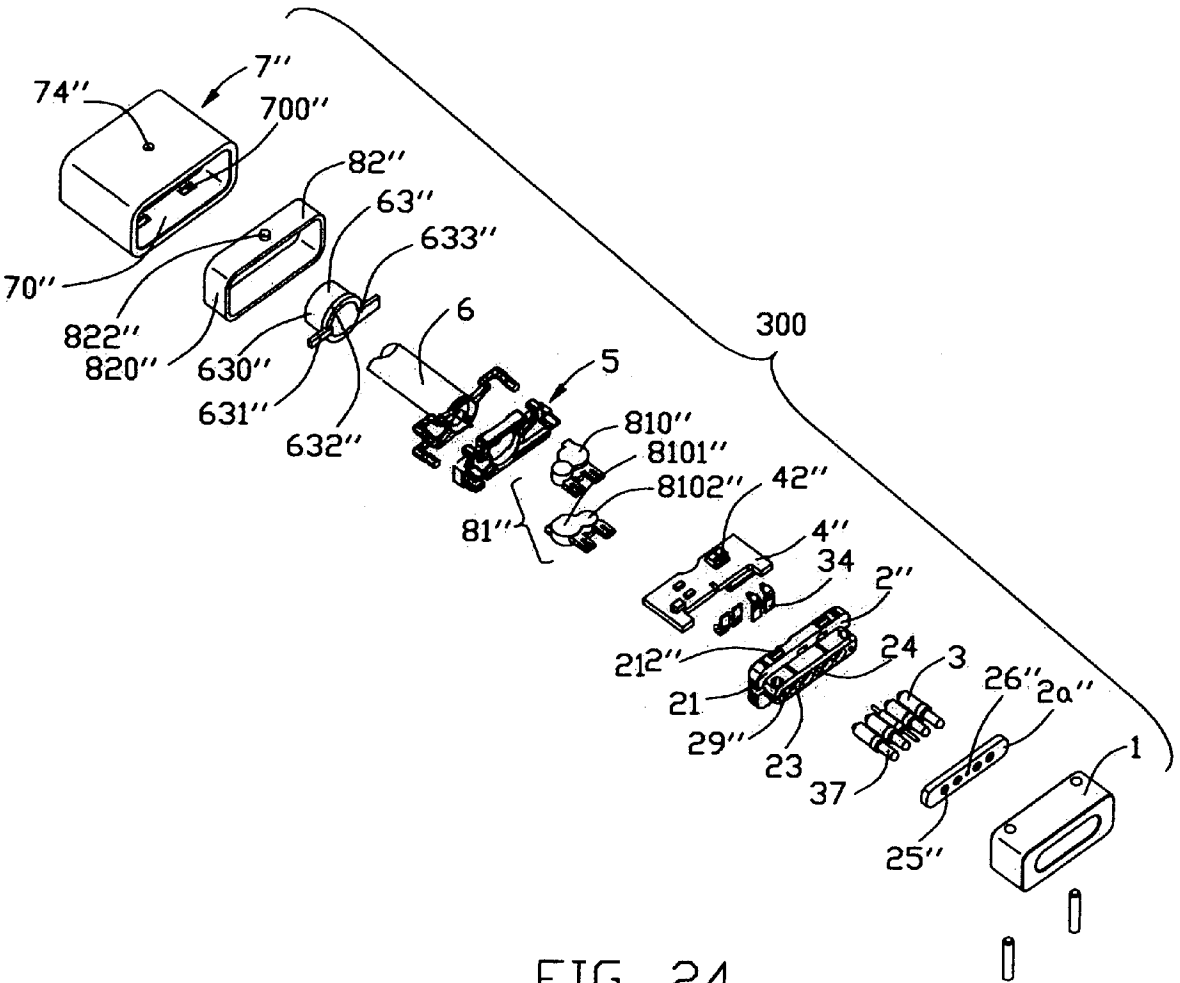
FIG. 24 is an exploded, perspective view of a connector assembly in accordance with the third embodiment of the present invention.
Figure 25:
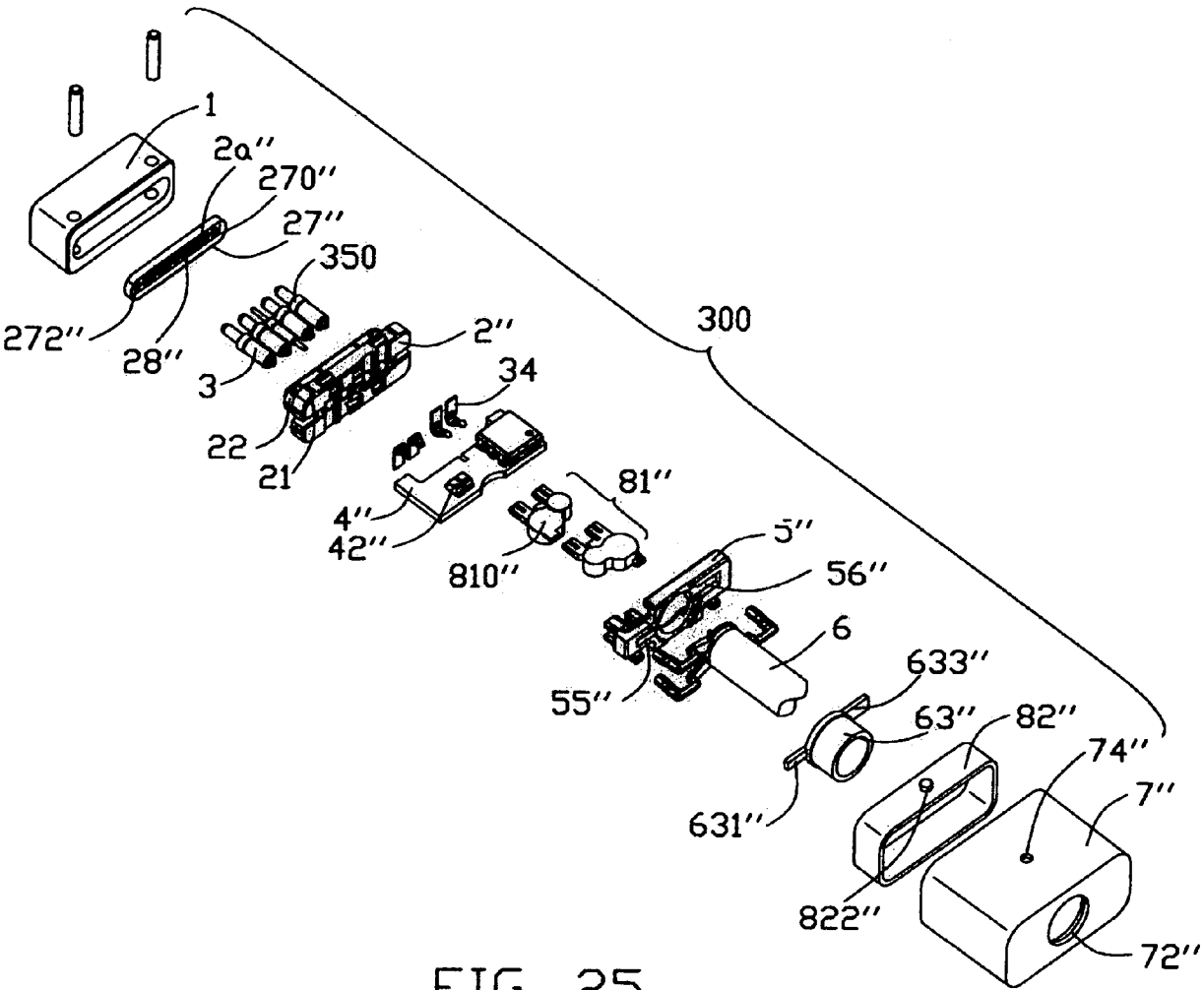
FIG. 25 is a view similar to FIG. 24, but viewed from a different aspect.
Figure 26:
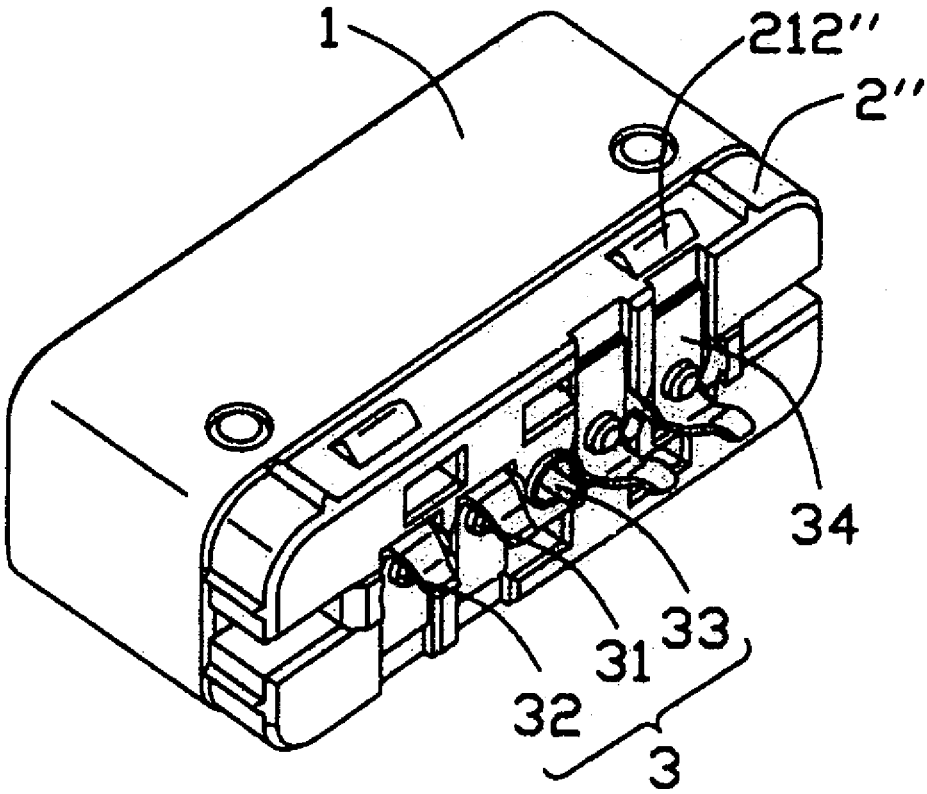
FIG. 26 is a partially assembled view of the connector assembly of FIG. 25.
Figure 27:
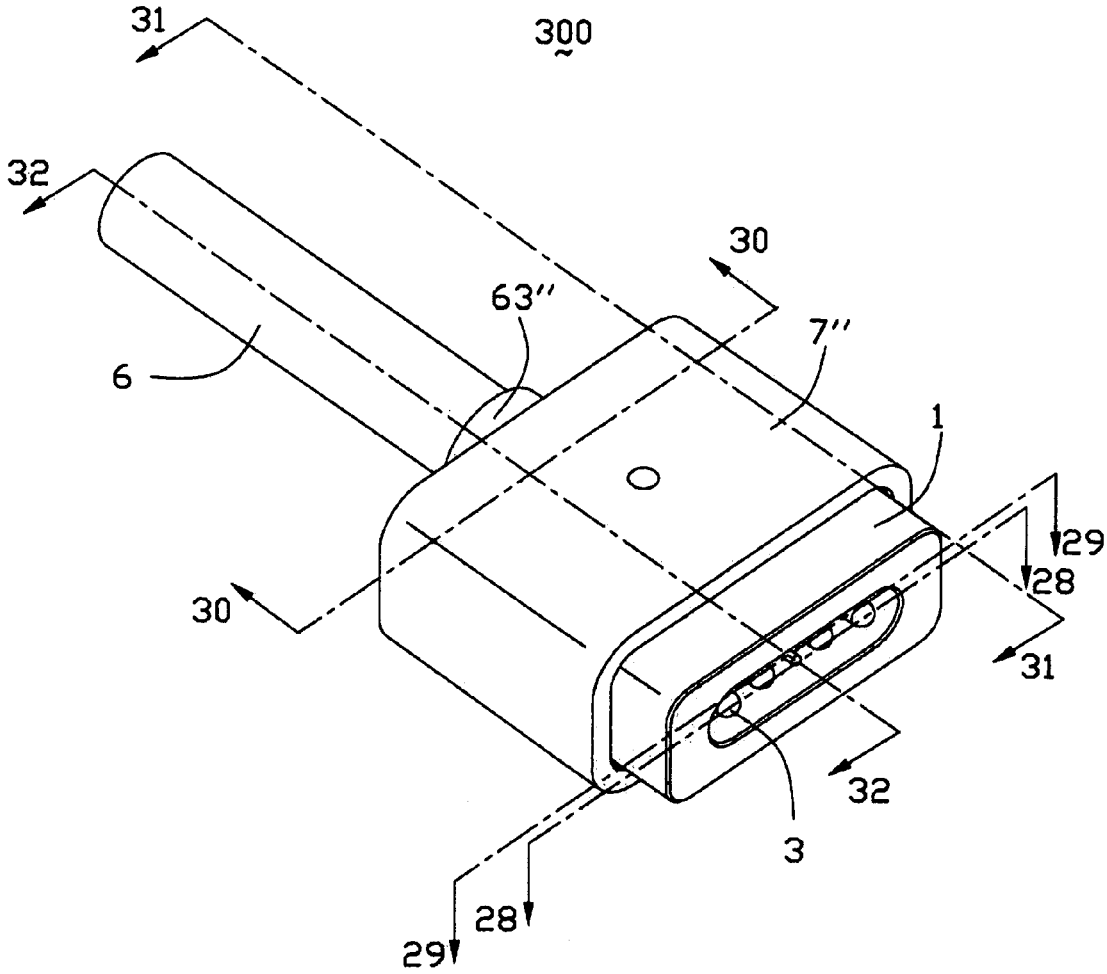
FIG. 27 is a perspective, assembled view of FIG. 24.
Figure 28:
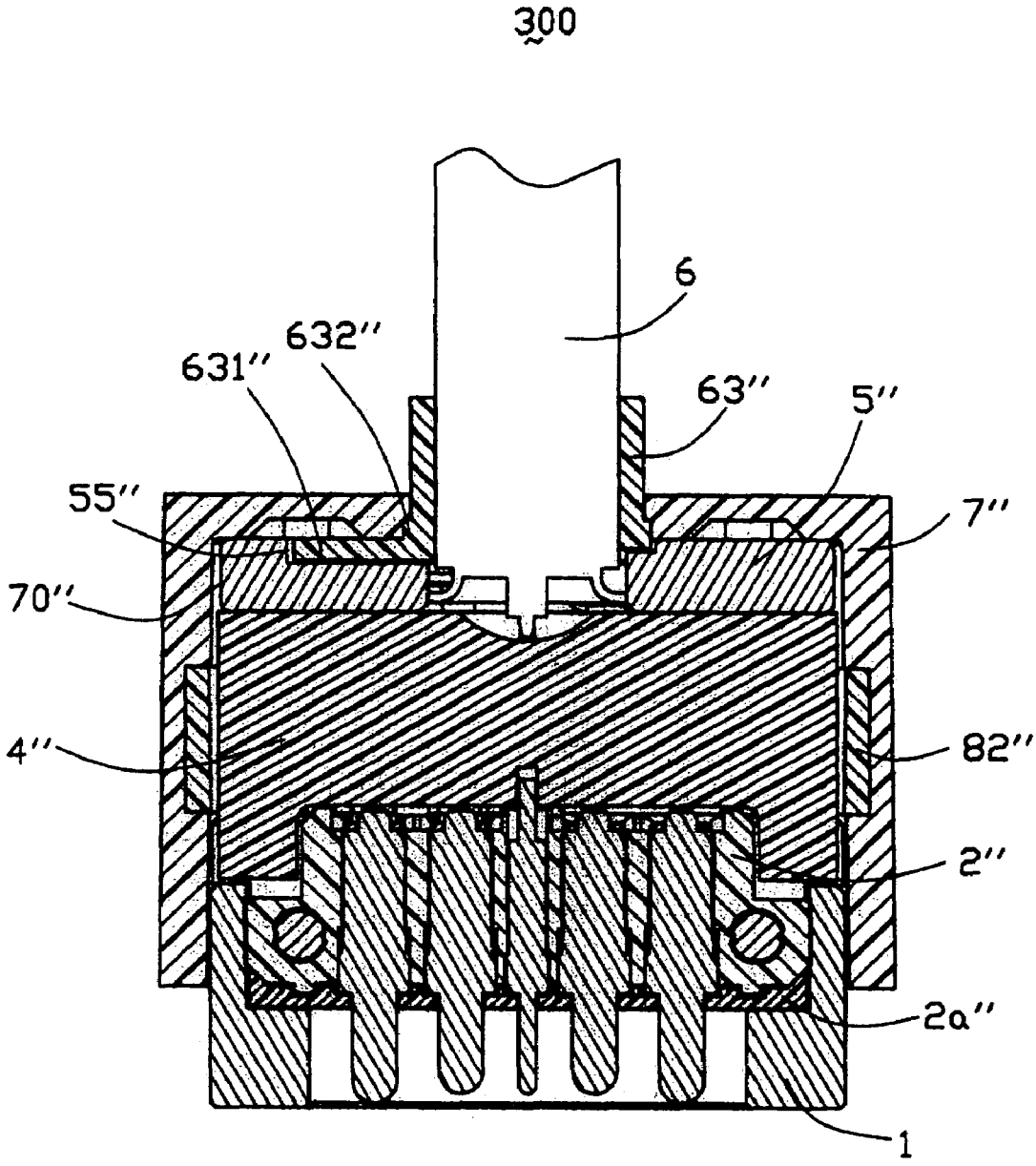
FIGS. 28-32 are cross-section views of the connector assembly taken along lines 28-28 to 32-32 of FIG. 27.
Figure 29:
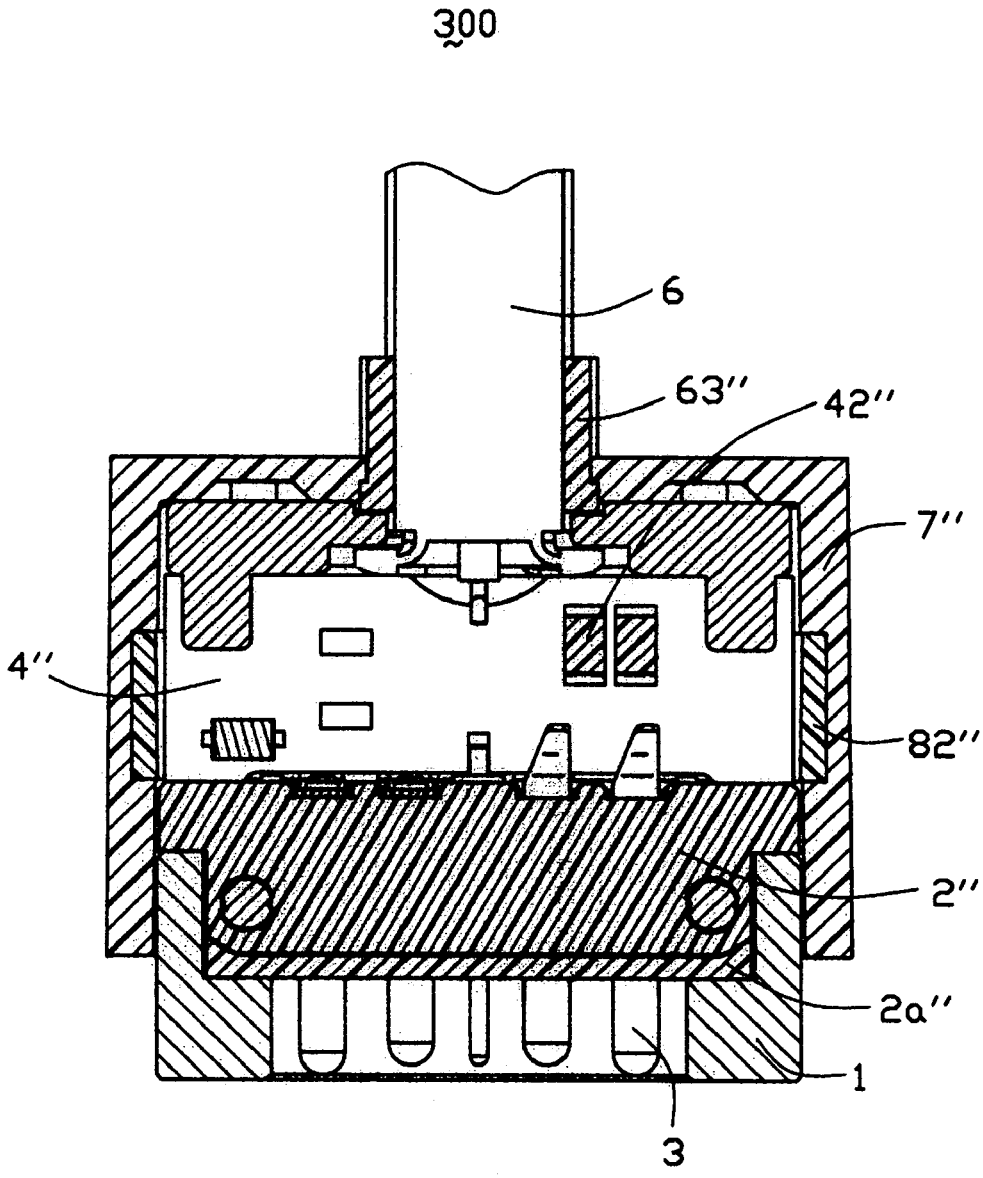
Figure 30:
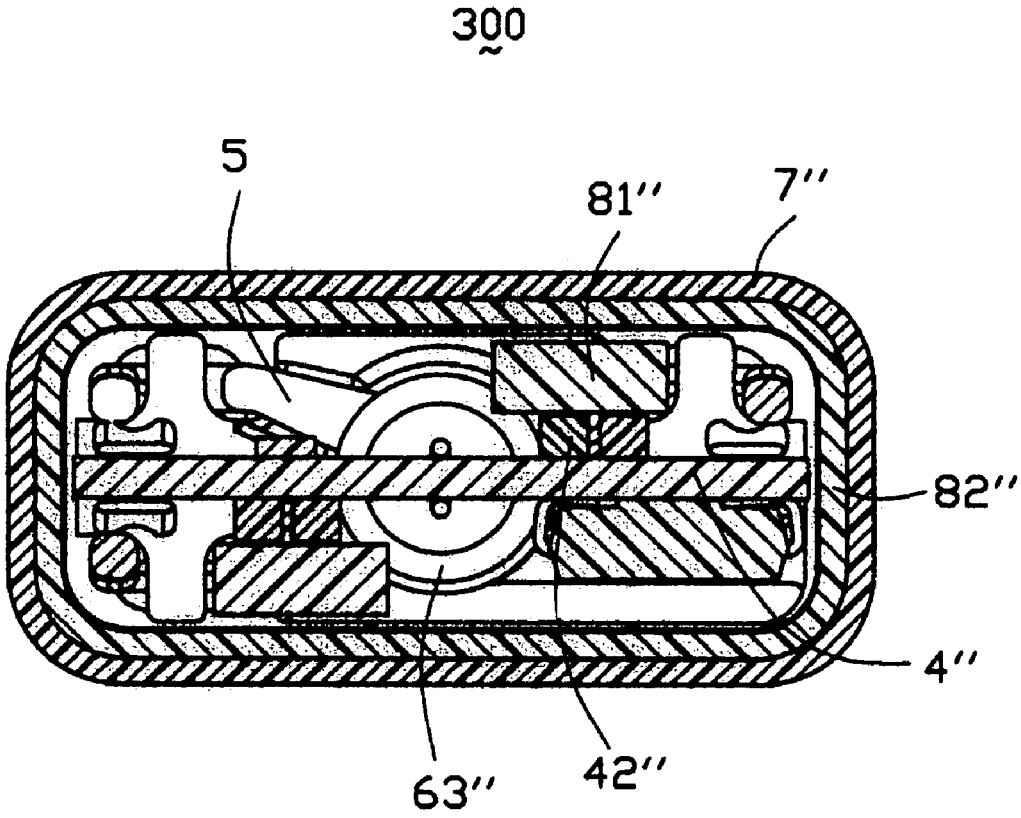
Figure 31:
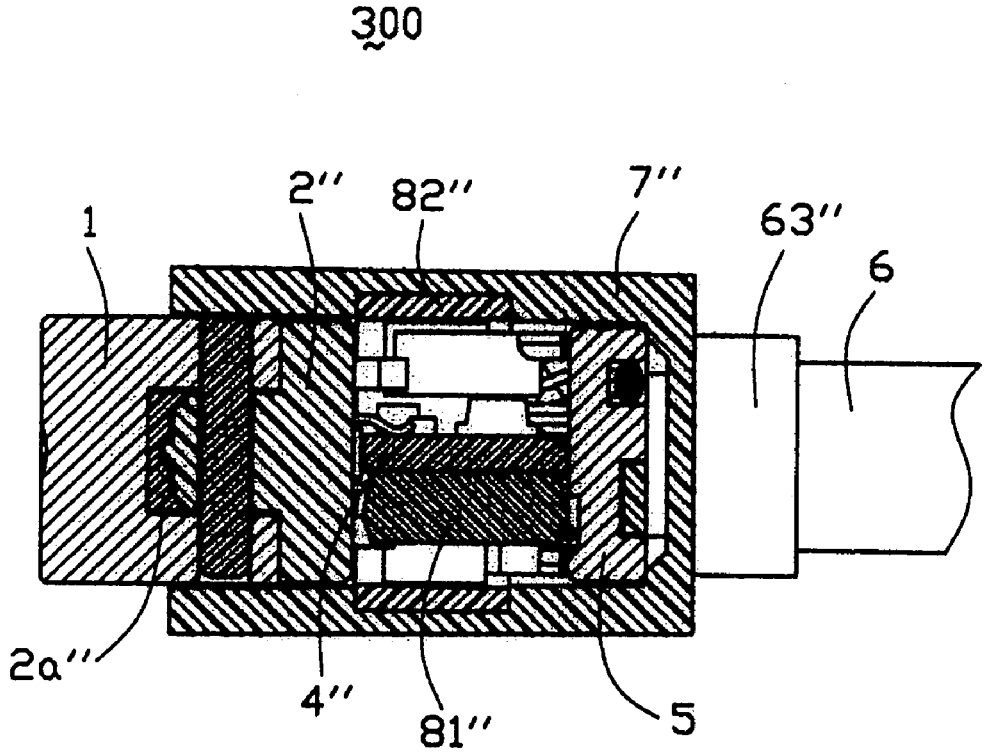
Figure 32:
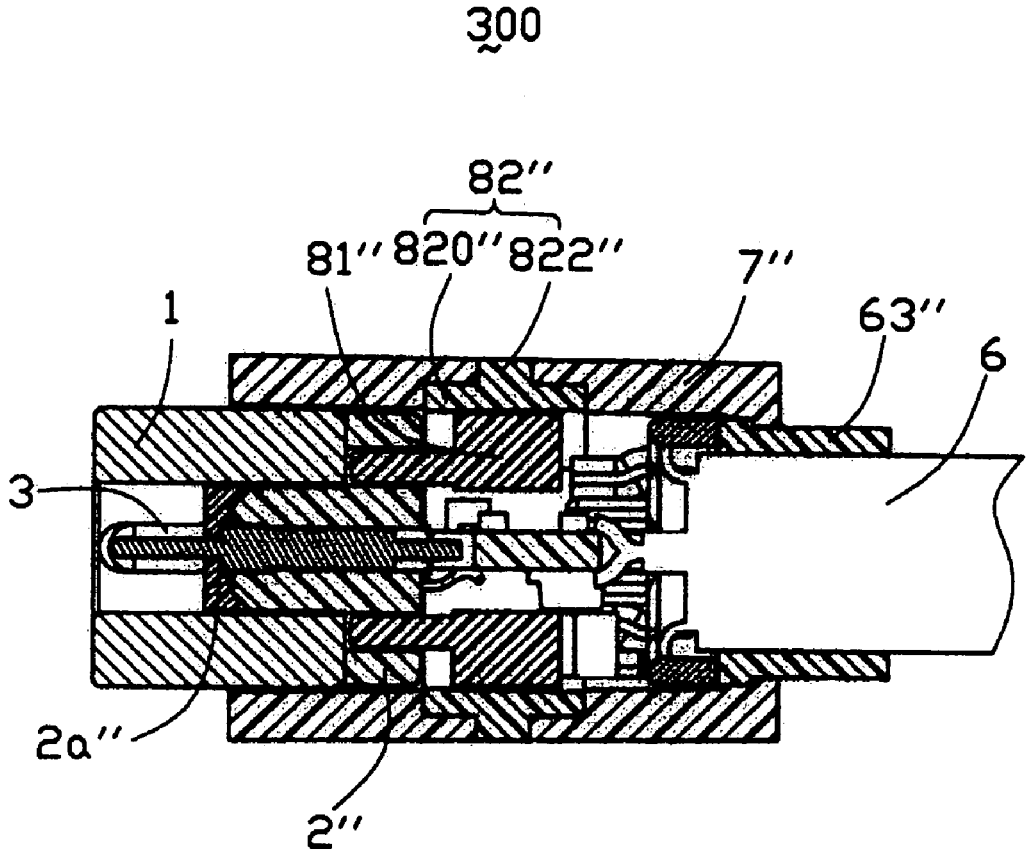

Then referring to FIG. 7 in conjunction with FIGS. 11 and 15, the front cover 1 is assembled to the housing 2 via a pair of pins 9. The tongue portion 22 is firstly inserted into the receiving passage 12 of the front cover 1 until the front surface thereof abuts against the step portions 16 of the front cover 1 and the base portion 21 abuts against a rear surface of the front cover 1. Thus, the tongue portion 22 is frictionally received in the receiving passage 12 of the front cover 1 by means of the pair of second friction ribs 220 engaging with the pins 9. Furthermore, the contacting portions 37 are exposed in the receiving cavity 10 with tip ends of the ground contacts 32 substantially coplanar with a front surface of the front cover 1. The pair of first engaging holes 222 respectively align with the pair of second engaging holes 14 of the front cover 1 in the vertical direction, thus, the pair of pins 9 respectively inserts through the second engaging holes 14 and the first engaging holes 222 to position the front cover 1 relative to the housing 2. Of course, the engagement between the front cover 1 and the housing 2 also can be realized by other means, such as using glue, latch means et al.

Figure 5:
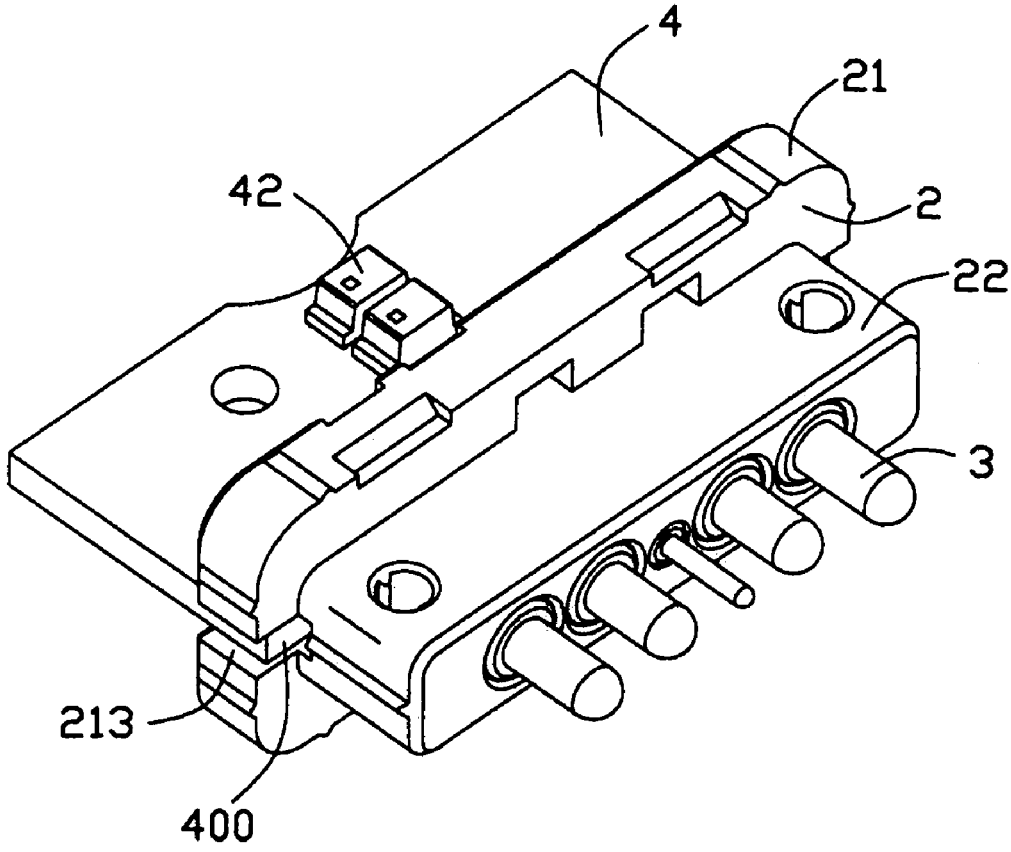
FIGS. 5-6 are partially assembled views of the connector assembly shown in FIG. 1, but viewed from different aspects.
Figure 6:
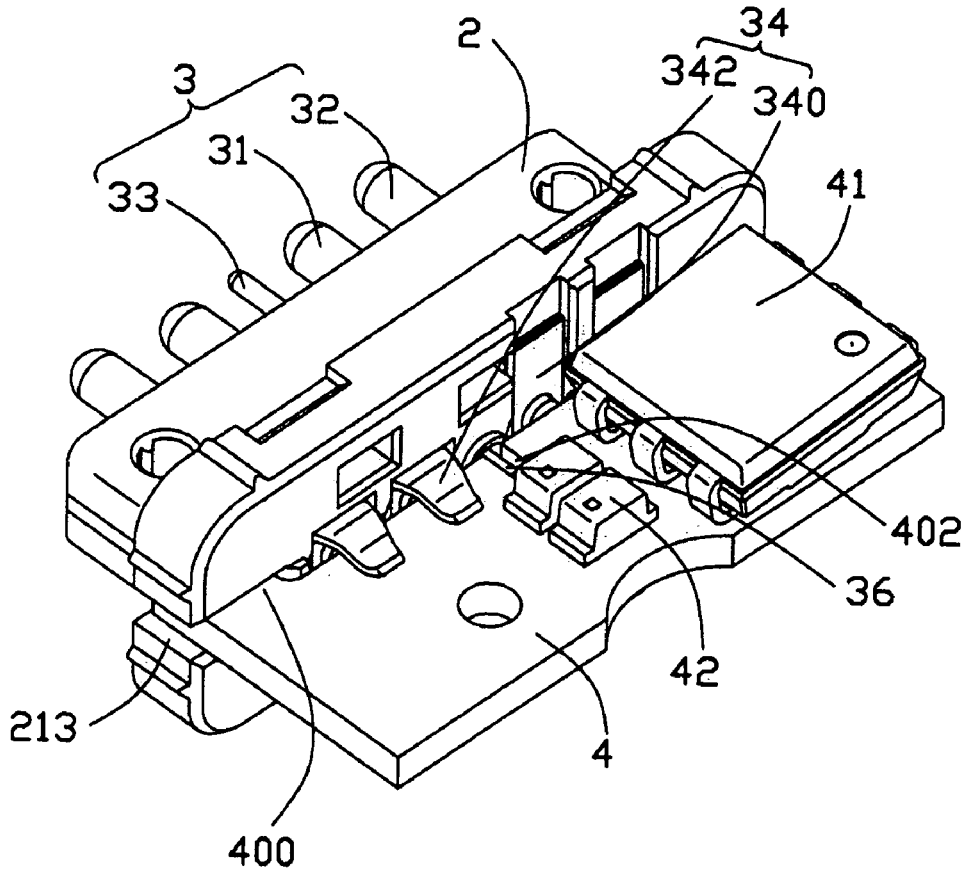

Then, referring to FIGS. 5-6 in conjunction with FIGS. 11 and 14-16, the circuit board 4 is assembled to the housing 2 and electrically connects with the conductive elements 34 and the end portion 36 of the detect contact 33 for forming electrical connection with the contacts 3. The pair of stretching arms 400 are respectively received in the second slots 213 with the guidance of the pair of tapered protrusions 214. The two pairs of opposite oriented curved tail portions 342 are respectively soldered to corresponding traces on opposite upper and lower surfaces of the circuit board 4 to sandwich the circuit board 4 therebetween and form electrical connection with the circuit board 4. The end portion 36 of the detect contact 33 is received in a slit 402 rearward extending from a middle of a front edge of the circuit board 4 to directly electrically connect with the pair of LEDs 42.

Now referring to FIGS. 1-3 in conjunction with FIGS. 9 and 13-15, the pair of first light pipes 81 are respectively assembled to the housing 2 with the pair of first and second engaging sections 812, 814 respectively frictionally received in the first slots 211 of the housing 2 via the ribs 816 formed thereon. Therefore, the first body sections 810 of the first light pipes 81 are respectively locate above corresponding LEDs 42 of the circuit board 4 for spreading the light emitting from the LEDs 42 outwardly.

Figure 9:
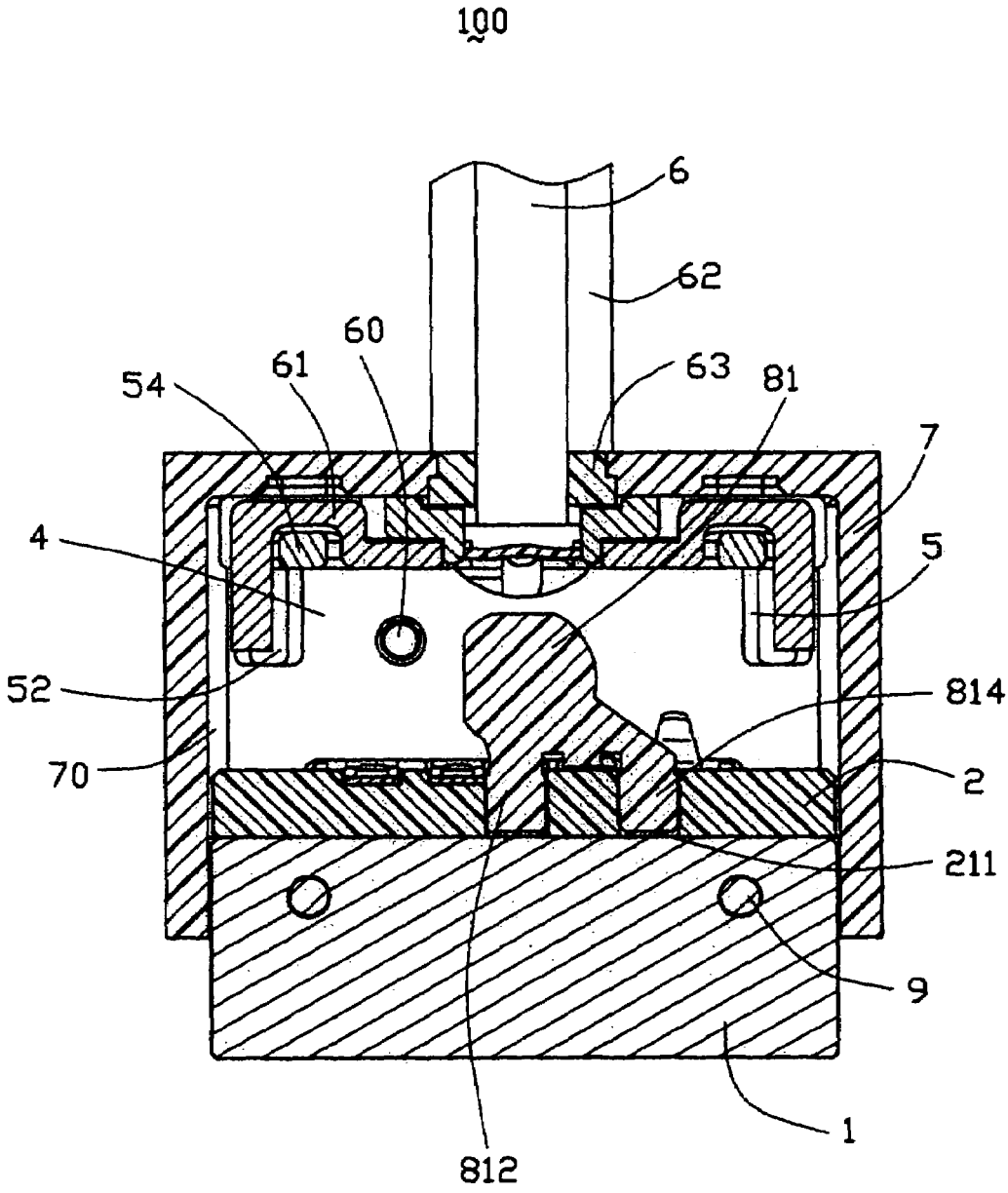
FIGS. 9-16 are cross-section views taken along lines 9-9 to 16-16 of FIGS. 7-8.
Figure 13:
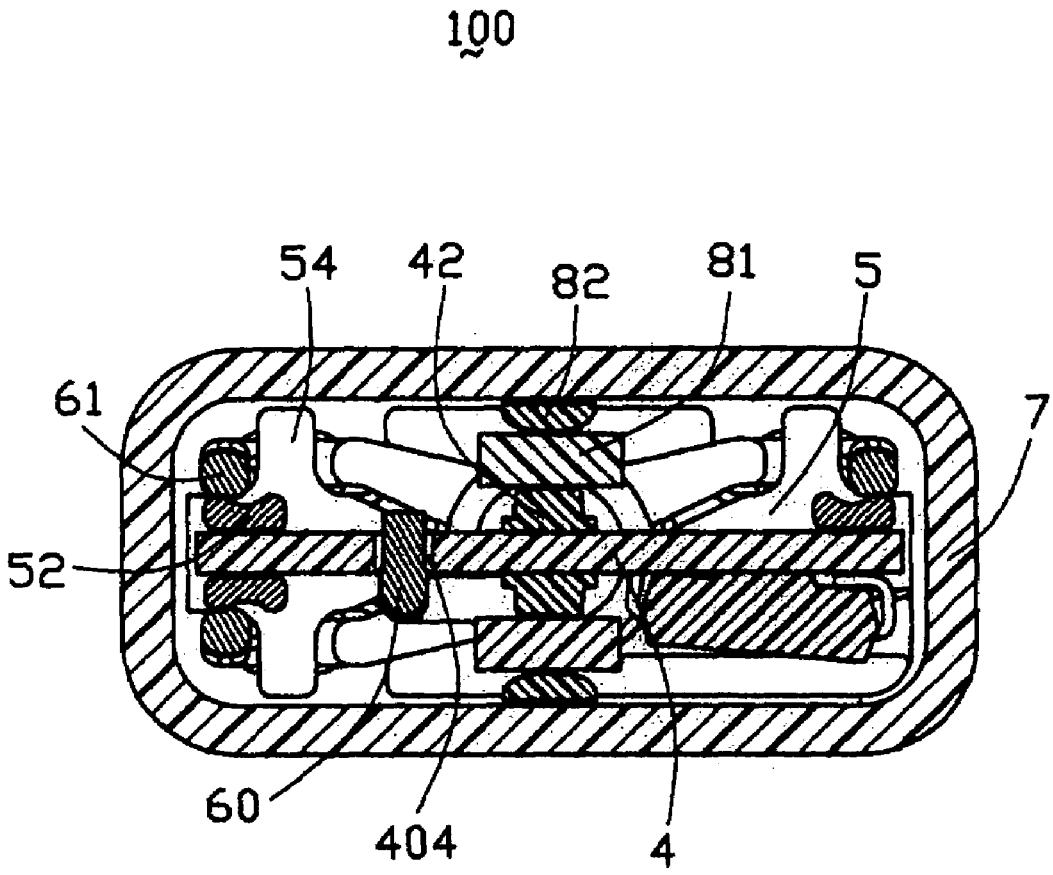
Figure 14:
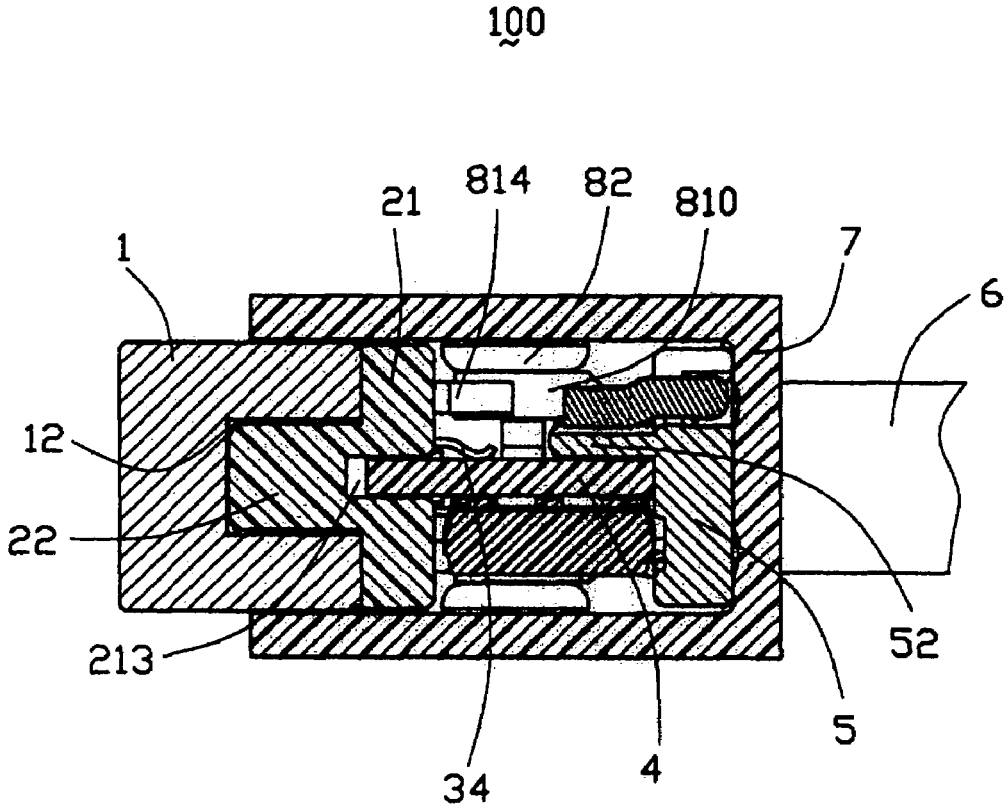

Now referring to FIGS. 1-3 in conjunction with FIGS. 9, 11 and 13, the cable 6 is firstly assembled to the strain relief member 5 then assembled to the circuit board 4 together with the strain relief member 5. The inner conductor 60 protrudes through the through hole 500 of the strain relief member 5, and the three parts of the metal braiding layer 61 firstly wrap to the routing portions 54 with forward portions located in the recess areas 520 of the jointing portions 52. Then, the forward portions of the metal braiding layer 61 are soldered with the jointing portions 52 to form electrical connection with the strain relief member 5. The strain relief member 5 is assembled to a rear end of the circuit board 4 with the jointing portions 52 thereof respectively soldered with opposite upper and lower surfaces of the circuit board 4 and the inner conductor 60 received in the wire-receiving hole 404 of the circuit board 4 and soldered with the circuit board 4. Therefore, the electrical connection between the cable 6 and the circuit board 4 further with the contacts 3 is established. The stuffing member 63 is assembled to the cable 6 from a rear-to-front direction and locates adjacent to front end of the outer jacket 62.

Referring to FIGS. 1-3 in conjunction of FIGS. 7-11, the pair of second light pipes 82 are respectively assembled to the rear cover 7 in a back-to-front manner with the positioning sections 822 respectively located in the pair of receiving holes 74 and the second body sections 820 thereof respectively abutting against opposite inner upper and lower surfaces of the rear cover 7. Then, the rear cover 7 with the pair of second light pipes 82 is engagingly assembled to the housing 2 with the protrusions 700 thereof respectively latching into the cutouts 212 of the housing 2 and the first friction ribs 210 of the housing 2 frictionally engaging with inner periphery of the rear cover 7 to reinforce the engagement therebetween. Thus, a rear portion of the front cover 1, the circuit board 4, the first light pipes 81, the strain relief member 5 and the front end of the cable 6 and the stuffing member 63 are respectively received in the receiving space 70 of the rear cover 7. The cable 6 protrudes through the stepped receiving passage 72 with the stepped-shape stuffing member 63 received in the stepped receiving passage 72 to fill spare space of the receiving passage 72. Meanwhile, the pair of second body sections 820 of the pair of second light pipes 82 respectively locate above corresponding first body sections 810 of the first light pipes 81. Thus, the pair of LEDs 42, the pair of first light pipes 81 and the pair of second light pipes 82 are in a stacked relationship in the vertical direction. Once the cable connector assembly 100 mates with the complementary connector normally, the LEDs 42 emit light outwardly, and the light may permeate through the pair of first light pipes 81 then to the second light pipes 82 to indicate the user the normal status of the cable connector assembly 100. Of course, in alternative embodiment, may not adopt the light pipes 81, 82, while, make the rear cover 7 of transparent or semitransparent material to spread the light emitting from LEDs 42 directly for indication. Furthermore, the rear cover 7 may be molded to the above elements to achieve reliable engagement.

A cable connector assembly 200 in accordance with the second embodiment of the present invention is illustrated in FIGS. 17-23. Compared with the cable connector assembly 100, structures of the contacts 3', the strain relief member 5', the cable 6' of the cable connector assembly 200 are different from those of the cable connector assembly 100. In addition, the cable connector assembly 200 further comprises a supporting member 64' for assisting the metal braiding layer of the cable 6' to be soldered with the strain relief member 5' and has no conductive elements 34. Now, detail description to the structures different from those of the cable connector assembly 100 will be given hereinafter, and the same structures same as those of the cable connector assembly 100 are omitted here.

Since the cable connector assembly 200 has no conductive elements 34, thus, corresponding first and second rectangular recesses 215, 216 disclosed in the cable connector assembly 100 are omitted in the cable connector assembly 200. Please refer to FIGS. 16-17 and 22, the contacts 3 also comprise a pair of power contacts 31', a pair of ground contacts 32' and a detect contact 33' and have the same arrangement as those of the contacts 3. The difference between the contacts 3', 3 is that each of the power and ground contacts 31', 32' has a tail portion 36' extending beyond the rear surface of the housing 2 to be soldered with corresponding traces of the circuit board 4 directly. The tail portion 36' is cut from the media portion 35 and has an arc shape.

The difference between the cables 6' and 6 exists in the metal braiding layers 61', 61. The metal braiding layer 61' of the cable 6' is shaped into a flat elliptical sheet around the center inner conductor 60. The supporting member 64' having the same shape as that of the metal braiding layer 61' and made from metal material is attached to a rear surface of the metal braiding layer 61' for enhancing the rigidity of the metal braiding layer 61'. The strain relief member 5' also has a rectangular shape with a certain thickness in front-back direction. An elliptical-shape recess 56' is recessed rearwardly from the front face of the strain relief member 5' to receive the supporting member 64' and the metal braiding layer 61' with the front face of the metal braiding layer 61' is substantially coplanar with the front face of the strain relief member 5'. In the present invention, the metal braiding layer 61' of the cable 6', the supporting member 64' and the strain relief member 5' are soldered with one another to form electrical connection. Furthermore, the supporting member 64' is sandwiched between the strain relief member 5' and the metal braiding layer 61'. Three bar-shape jointing portions 52' extend forwardly from the front face of the strain relief members 5'. Two of the jointing portions 52' both extend from one lateral side of the strain relief member 5' and align with each other in a vertical direction with a distance spaced from each other substantially equal to the thickness of the circuit board 4, while the remaining jointing portion 52' extends from the other lateral side of the strain relief member 5' and align with one of the two jointing portions 52' along a longitudinal direction of the strain relief member 5'. Thus, in assembly, the rear edge of the circuit board 4 is sandwiched between the jointing portions 52' and form electrical connection with the strain relief member 5' by soldering.

Other structures and assembly process of the cable connector assembly 200 same as those of the cable connector assembly 100 are omitted here.

Now referring to FIGS. 24-32, a cable connector assembly 300 in accordance with the third embodiment of the present invention is illustrated.

The first difference between the cable connector assembly 300 and the cable connector assembly 100 is that the cable connector assembly 300 comprises a cosmetic element **2*a*" assembled to the housing 2" for cosmeticize the visual effect of the cable connector assembly 300. The cosmetic element 2*a*" is of ellipse-shape and defines four first channels 25" and a second channel 26" corresponding to the first receiving passages 23 and the second receiving passage 24 of the housing 2" with dimensions corresponding to the diameters of the contacting portions 37 of the contacts 3. An entranceway 27" is recessed forwardly from a rear surface of the cosmetic element 2*a*", thus, forming an inner front face 270". A plurality of different-size passageways 28" recess forwardly from the inner front face 270" to communicate with corresponding first and second channels 25", 26" with dimensions corresponding to the diameters of the engaging sections 350 of the contacts 3. A pair of positioning recesses 272" also recesses forwardly from the inner front face 270" and locates at opposite sides of the cosmetic element 2*a*". Corresponding to the structures of the cosmetic element 2*a*", the tongue portion 22" is shortened along the front-back direction and a front end thereof is tapered to form a slant edge along outer periphery thereof for facilitating the assembly of the cosmetic element 2*a*" and received in the entranceway 27". The housing 2" forms a pair of positioning protrusions 29" to be received into the positioning recesses 272" of the cosmetic element 2*a*" for positioning the right position of the cosmetic element 2*a*". After the cosmetic element 2*a*" is assembled to the housing 2" and the contacts 3, the portions of the engaging sections 350 exposed outside of the housing 2" and the contacting portions 37 of the contact 3 are respectively received in the passageways 28" and the first and second channels 25", 26", thus, the front visual effect is improved. The housing 2" with the cosmetic element 2*a*" is assembled to the front cover 1** as described above, thus, same detailed description is omitted here.

The second difference exists in the circuit board 4". The pair of LEDs 42" is moved from the middle of the circuit board 4 to opposite right side and left side relative to the middle axis extending along front-back direction. Corresponding to the structure change of the circuit board 4", the first body section 810" of the first light pipe 81" comprises a first section 8101" overlapping corresponding LED 42" and a second section 8102" connecting with the first section 8101" and aligning with corresponding structure of the second light pipe 82".

The third difference is the shape of the stuffing member 63" is different from that of the stuffing member 63. The stuffing member 63" comprises a circular main portion 630", an enlarged stuff portion 632" formed at front end of the main portion 630", and a pair of first and second orientation portions 631", 633" extending transversely from outer edge of the stuff portion 632" with different widths along the vertical direction. In addition, the first and second orientation portions 631", 633" are arranged with unsymmetrical relationship with the first orientation portion 631" locating at an upper position than the second orientation portion 633" along the vertical direction. Correspondingly, the strain relief member 5 defines first and second slots 55", 56" to receive the first and second orientation portions 631", 633" for orientating the stuffing member 63" in position.

Different from the cable connector assembly 100, the cable connector assembly 300 forms the second light pipe 82" and the rear cover 7" by means of injection or molding. Firstly, the second light pipe 82" is molded from transparent or semitransparent material and comprises a belt-shape second body section 820" and a pair of positioning sections 822" respectively formed on middle areas of the upper and lower walls of the second body section 820". Secondly, the rear cover 7" is molded over the second light pipe 82" to receive the second light pipe 82" therein. The rear cover 7" defines a receiving cavity 70" recessed rearwardly from a front surface thereof to communicate with a stepped receiving passage 72" in a rear edge thereof. The belt-shape body section 820" is received in a middle annular passage (not labeled) recessed outwardly from inner periphery of the rear cover 7" with the pair of positioning sections 822" respectively received in a pair of circular receiving holes 74" in upper and lower surfaces of the rear cover 7" to be exposed outside for indication. Then, the second light pipe 82" and the rear cover 7" together assembled to the assembly described above with a rear end of the front cover 1, the housing 2", the conductive elements 34, the circuit board 4", the first light pipes 81", the strain relief member 5, and the front end of the cable 6 received in the receiving cavity 70" of the rear cover 7". Corresponding to the protrusions 212" formed on upper and lower surfaces of the base portion 21 of the housing 2", the rear cover 7" forms two pairs of cutouts 700" to receive the protrusions 212" therein for increasing the retaining force between the housing 2" and the rear cover 7". The second sections 8102" of the first light pipes 81" respectively align with the positioning sections 822" of the second light pipes 82" to spread the light emitting from the LEDs 42" to outside for indication. In addition, the enlarged stuff portion 632" received in the stepped receiving passage 72" with the main portion 630" exposed beyond the rear cover 7".

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

a housing;

a signal terminal and a ground terminal respectively assembled to the housing;

a cable comprising a signal conductor directly electrically connecting with the signal terminal, a metal braiding layer enclosing the signal conductor, and an outer jacket enclosing the metal braiding layer;

a strain relief member comprising a body portion defining a through hole to permit the signal conductor protruding therethrough and directly electrically connecting with the signal terminal, and a jointing portion formed with the body portion to directly connect with the ground terminal, wherein the metal braiding layer of the cable electrically connects with one of the jointing portion and body portion of the strain relief member; and a rear cover assembled with the housing to enclose the electrical connection among the cable, the strain relief member and the signal and ground terminals.

2. The cable connector assembly as claimed in claim 1, wherein the jointing portion defines a recess area therein, and wherein the metal braiding layer of the cable is formed to be received in the recess area of the jointing portion and soldered with the jointing portion.

3. The cable connector assembly as claimed in claim 2, wherein the strain relief member forms a routing portion extending from the body portion and not aligning with the jointing portion along a longitudinal direction of the body portion, and wherein the metal braiding layer of the cable is firstly wrapped with the routing portion, then soldered with the jointing portion.

4. The cable connector assembly as claimed in claim 1, wherein the metal braiding layer is formed as a flat sheet around the at least one signal conductor and attached to the body portion of the strain relief member.

5. The cable connector assembly as claimed in claim 4, further comprising a supporting member soldered with the metal braiding layer and attached to the body portion of the strain relief member together with the metal braiding layer.

6. The cable connector assembly as claimed in claim 5, wherein the body portion defines a recess having the same shape as that of the supporting member to receive the supporting member and the metal braiding layer.

7. The cable connector assembly as claimed in claim 1, further comprising a circuit board, and wherein the signal terminal and the ground terminal are formed with the circuit board.

8. The cable connector assembly as claimed in claim 7, further comprising a signal contact for power transmission and a ground contact respectively connecting with the circuit board to respectively form electrical connections with the signal conductor and the metal braiding layer of the cable.

9. The assembly as claimed in claim 8, further comprising a pair of conductive elements, and wherein each conductive element comprises connecting portion electrically connecting with end portion of corresponding signal and ground contacts, and a tail portion electrically connecting with the circuit board.

10. The assembly as claimed in claim 9, wherein each conductive element is of L-shape.

11. The cable connector assembly as claimed in claim 8, further comprising a detect contact assembled to the housing, and a LED electrically connecting with the detect contact and capable of being actuated to emit light for indicating normal status of the cable connector assembly and a complementary connector.

12. The cable connector assembly as claimed in claim 11, wherein each of the signal contact, ground contact and the detect contact is of a POGO type and comprises a front contacting portion and a rear end portion, and wherein the front contacting portion is capable of being actuated to move along a mating direction when the cable connector assembly mates with the complementary connector.

13. The cable connector assembly as claimed in claim 11, further comprising a light pipe assembled to the rear cover and aligning with the LED to spread the light emitted from the LED outwardly.

14. The cable connector assembly as claimed in claim 1, further comprising a front cover assembled with the housing and the rear cover.

15. The cable connector assembly as claimed in claim 14, wherein the front cover is made of metal material and capable of being attracted by a complementary connector.

16. The cable connector assembly as claimed in claim 14, wherein the housing and the front cover are secured to each other by a pin extending into the housing and the front cover.

17. An electrical connector comprising:

an insulative housing with a plurality of contacts therein;

a printed circuit board located behind the housing and electrically connected to the corresponding contacts;

at least one light pipe structure located above the printed circuit board in a vertical direction;

a strain relief located behind the printed circuit board;

a cable with an inner conductor and an outer braiding extending through the strain relief and mechanically and electrically connected to the printed circuit board.

18. The connector as claimed in claim 17, wherein a plurality of conductive elements are intermediated between the contacts and the printed circuit board.

* * * * *